US011260414B2

(12) United States Patent
Hattori et al.

(10) Patent No.: US 11,260,414 B2
(45) Date of Patent: Mar. 1, 2022

(54) COATING METHOD AND COATING DEVICE

(71) Applicant: MAZDA MOTOR CORPORATION, Hiroshima (JP)

(72) Inventors: Hiroaki Hattori, Hiroshima (JP); Masanori Takasaki, Hatsukaichi (JP); Masakazu Tsuji, Higashihiroshima (JP); Go Ishizaki, Hiroshima (JP); Yasuhide Fukuda, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 206 days.

(21) Appl. No.: 16/496,841

(22) PCT Filed: Feb. 14, 2018

(86) PCT No.: PCT/JP2018/005034
§ 371 (c)(1),
(2) Date: Sep. 23, 2019

(87) PCT Pub. No.: WO2018/179940
PCT Pub. Date: Oct. 4, 2018

(65) Prior Publication Data

US 2020/0078811 A1 Mar. 12, 2020

(30) Foreign Application Priority Data

Mar. 30, 2017 (JP) ..... JP2017-069348

(51) Int. Cl.
*B05D 3/00* (2006.01)
*B05B 13/04* (2006.01)
(Continued)

(52) U.S. Cl.
CPC ..... *B05B 13/0431* (2013.01); *B05B 12/00* (2013.01); *B05B 13/0221* (2013.01);
(Continued)

(58) Field of Classification Search
CPC . B05B 12/00; B05B 13/0221; B05B 13/0431; B05B 13/0452; B05C 5/00;
(Continued)

(56) References Cited

U.S. PATENT DOCUMENTS 4,734,572 A 3/1988 Gorman
6,689,219 B2 * 2/2004 Birmingham ..... B25J 9/1694 118/669
(Continued)

FOREIGN PATENT DOCUMENTS

DE 102008015834 A1 10/2009
JP H05-056275 U 7/1993
(Continued)

OTHER PUBLICATIONS

An Office Action issued by the Russian Patent Office dated May 27, 2020, which corresponds to Russian Patent Application No. 2019129814 and is related to U.S. Appl. No. 16/496,841.
(Continued)

*Primary Examiner* — Alexander M Weddle
(74) *Attorney, Agent, or Firm* — Studebaker & Brackett PC

(57) ABSTRACT

The present application discloses a coating method including: detecting a shape of an object over a coating zone which extends from a start point position to an end point position to generate first detection data before application of coating agent to the object; moving a bracket for holding a nozzle for discharging the coating agent with bringing the bracket into contact with the object to apply the coating agent to the object over the coating zone; detecting a shape of the object after application of the coating agent over the coating zone, to generate second detection data; extracting first extraction data and second extraction data in correspondence to detection positions intermittently set in the coating zone from the
(Continued)

first detection data and the second detection data; and comparing the first extraction data with the second extraction data to detect a coating state of the coating agent.

7 Claims, 26 Drawing Sheets

(51) Int. Cl.

| | |
|---|---|
| ***B05B 12/00*** | (2018.01) |
| *B05B 13/02* | (2006.01) |
| *B05C 5/00* | (2006.01) |
| *B05C 11/00* | (2006.01) |

(52) U.S. Cl.
CPC ..... *B05B 13/0452* (2013.01); *B05C 5/00* (2013.01); *B05C 11/00* (2013.01)

(58) Field of Classification Search
CPC ..... B05C 5/0204; B05C 5/0216; B05C 11/00; B05C 11/1005; B05C 11/1021; B05D 3/00
See application file for complete search history.

(56) References Cited

U.S. PATENT DOCUMENTS

| | | | |
|---|---|---|---|
| 2011/0297118 | A1 | 12/2011 | Izawa et al. |
| 2017/0238424 | A1 | 8/2017 | Chadin et al. |

FOREIGN PATENT DOCUMENTS

| | | | |
|---|---|---|---|
| JP | 2001-149841 | A | 6/2001 |
| JP | 2004-016883 | A | 1/2004 |
| JP | 2008-229444 | A | 10/2008 |
| JP | 2010-158636 | A | 7/2010 |
| JP | 2015-199034 | A | 11/2015 |
| JP | 2015-205226 | A | 11/2015 |
| RU | 2483139 | C1 | 5/2013 |
| RU | 2588921 | C2 | 7/2016 |

OTHER PUBLICATIONS

The extended European search report issued by the European Patent Office dated Apr. 9, 2020, which corresponds to European Patent Application No. 18776342 0-1015 and is related to U.S. Appl. No. 16/496,841.
International Search Report issued in PCT/JP2018/005034; dated May 15, 2018.

* cited by examiner

COATING METHOD AND COATING DEVICE

TECHNICAL FIELD

The present invention relates to a coating method and a coating device for applying a sealing agent.

BACKGROUND ART

Teaching operations have been performed before a coating agent such as a sealing agent or a paint is applied to an object to make a robot memorize a shape of the object, the robot being configured to move a coating device for discharging the coating agent (c.f. Patent Document 1). Shape information acquired by the teaching operations is reflected on an operation of the coating device. Accordingly, the coating agent is applied to an appropriate position on the object.

An operator performing the teaching operations is required to measure a shape of an object at a lot of measurement points on the object. Accordingly, the teaching operations require a large effort and a long time on the operator. In short, the conventional teaching operations result in a large decrease in production efficiency for producing the object.

DOCUMENT LIST

Patent Document

Patent Document 1: JP 2015-199034 A

SUMMARY OF INVENTION

It is an object of the present invention to provide techniques of reducing effort of teaching operations and shorting a time of the teaching operations.

A coating method according to one aspect of the present invention uses a nozzle for discharging a coating agent, a first sensor configured to detect a shape of a first surface of an object and a second sensor configured to detect a shape of a second surface of the object which is opposite to the first surface. The coating method includes: continuously moving a detection area formed by the first and second sensors which are held by a bracket so that the first sensor faces the first surface whereas the second sensor faces the second surface to make the object be situated between the first and second sensors, over a coating zone which extends from a predetermined start point position to a predetermined end point position to make the first and second sensors detect the shapes of the first and second surfaces before application of the coating agent to the object and generate first detection data; moving the bracket which holds the nozzle with bringing the bracket into contact with the object to apply the coating agent to the object over the coating zone; continuously moving the detection area over the coating zone to make the first and second sensors between which the object is situated detect the shapes of the first and second surfaces after the application to the coating agent to the object and generate second detection data; extracting first extraction data in correspondence to detection positions intermittently set in the coating zone from the first detection data, and second extraction data in correspondence to the detection positions from the second detection data; and comparing the first extraction data with the second extraction data to detect a coating state of the coating agent.

A coating device according to another aspect of the present invention is configured to apply a coating agent to an object which includes a first surface and a second surface opposite to the first surface. The coating device includes: a controller having a storage configured to store zone information which defines a coating zone extending from a predetermined start point position on the object to a predetermined end point position on the object; a sensor device including a first sensor facing the first surface to detect a shape of the first surface and a second sensor facing the second surface to detect a shape of the second surface, the first and second sensors being configured to form a detection area for detecting a shape of the object; a nozzle configured to apply the coating agent to the object; a bracket configured to hold the sensor device and the nozzle; and a robot configured to move the bracket over the coating zone under a control of the controller. The robot brings the bracket into contact with the object while the coating agent is discharged from the nozzle. The storage stores first detection data acquired by the detection area scanning the object over the coating zone before the coating agent is applied to the object, and second detection data acquired by the detection area scanning the object to which the coating agent has been applied over the coating zone in the detection area. The controller includes: (i) an extractor configured to extract first extraction data in correspondence to detection positions intermittently set in the coating zone from the first detection data, and second extraction data in correspondence to the detection positions from the second detection data, and (ii) a comparison portion configured to compare the first extraction data with the second extraction data and detect a coating state of the coating agent.

The aforementioned techniques may reduce effort for teaching operations and shorten a time for the teaching operations.

Other objects, technical features, and advantageous effects of the present invention will become more apparent with reference to the detailed description made hereinafter and attached drawings.

DESCRIPTION OF EMBODIMENTS

Exemplary techniques which may simplify the teaching operations are described below. Directional terms such as "left", "right", "up", "down", "front" and "rear" are used only for the purpose of clarifying the description. Accordingly, the principles of the present embodiment are not limited by these directional terms at all.

(Entire Configuration of Coating Device)

Figure 1:
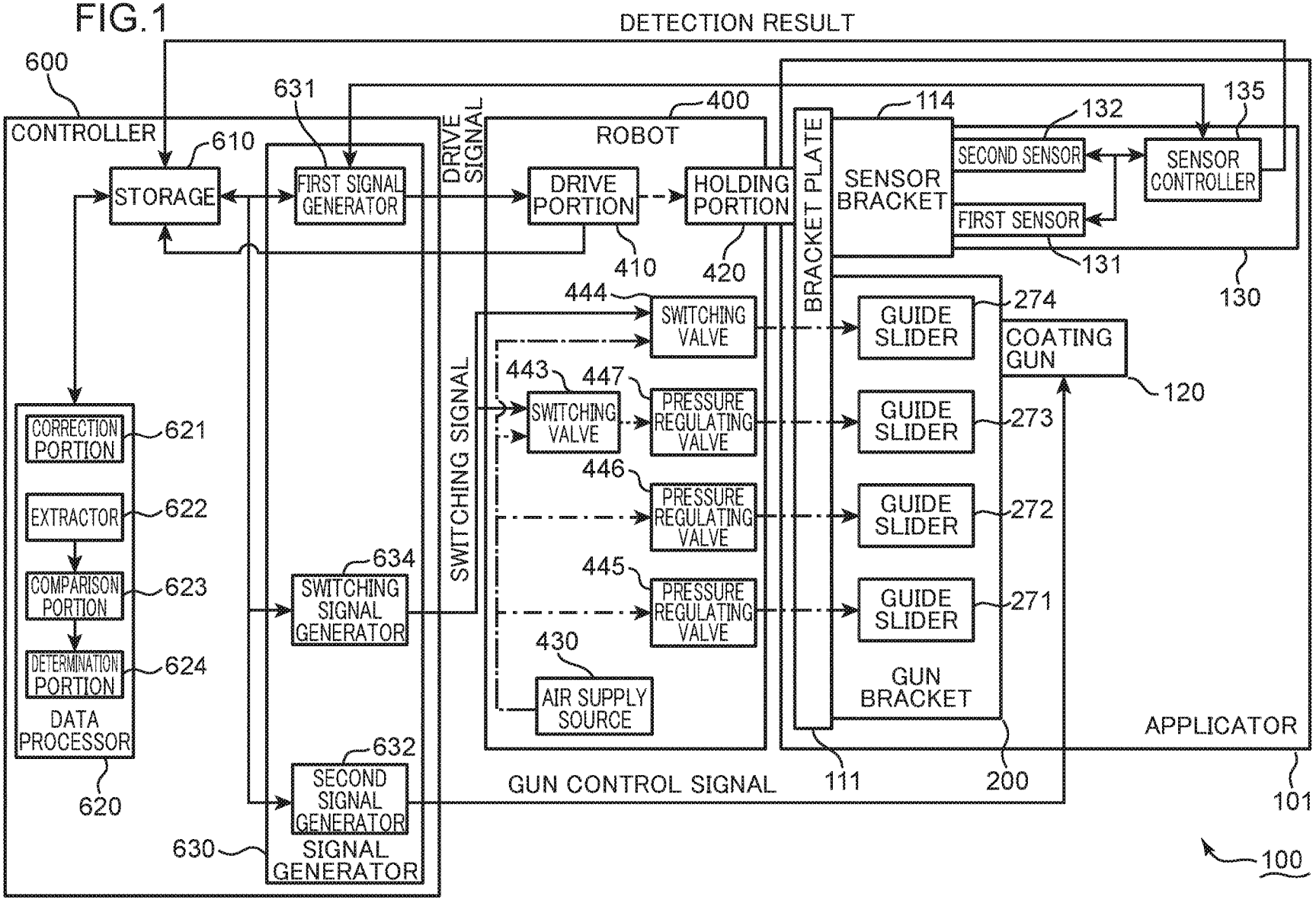
FIG. 1 is a schematic block diagram of an exemplary coating device.

FIG. 1 is a block diagram showing the schematic functional configuration of an exemplary coating device 100. The coating device 100 is described with reference to FIG. 1. In FIG. 1, the solid arrow indicates transmission of a signal or data. In FIG. 1, the dotted arrow indicates transmission of a force.

The coating device 100 includes an applicator 101, a robot 400 and a controller 600. The coating device 100 performs a correction step, a first detection step, a coating step, a second detection step and a data processing step. The correction step is performed to correct a movement trajectory preset for the robot 400 so that the movement trajectory fits to a relative positional relationship between the robot 400 and an object to which a coating agent is applied. When the relative positional relationship between the robot 400 and the object is always determined accurately, the correction step may not be performed. Accordingly, the principles of the present embodiment are not limited by the correction step at all.

The first detection step is performed after the correction step is performed. The first detection step is performed to detect a shape of the object before the coating agent is applied to the object. The coating step is performed after the first detection step is performed. The coating agent is applied to the object in the coating step. The second detection step is performed after the coating step is performed. The second detection step is performed for detecting a shape of the object to which the coating agent is applied. The data processing step is performed after the second detection step is performed. In the data processing step, the controller 600 processes data acquired in the first and second detection steps to determine whether or not the coating agent is appropriately applied to the object.

The applicator 101 includes a bracket plate 111, a sensor bracket 114, a coating gun 120, a sensor device 130 and a gun bracket 200. The bracket plate 111 is connected to the robot 400. A movement trajectory of a connection point at which the bracket plate 111 is connected to the robot 400 is preliminarily stored in the controller 600 as movement trajectory data. The movement trajectory data is corrected in the aforementioned correction step.

The sensor bracket 114 and the gun bracket 200 are attached to the bracket plate 111. The structure of the gun bracket 200 is described in the context of the coating step.

The sensor device 130 includes a first sensor 131, a second sensor 132 and a sensor controller 135. The first and second sensors 131, 132 are mounted on the sensor bracket 114. The first and second sensors 131, 132 detect a shape of the object in the first and second detection steps, and generate electric signals indicating the detected shape. The electric signals are outputted to the controller 600 via the sensor controller 135 as a detection result. The sensor controller 135 controls output timing of the electric signals to the controller 600. In addition, the sensor controller 135 may be used for changing a setting of operational characteristics of the first and second sensors 131, 132 (e.g. sampling frequency and optical setting).

The coating gun 120 is mounted on the gun bracket 200. Accordingly, the coating gun 120 and the sensor device 130 are held by the bracket plate 111, the sensor bracket 114 and the gun bracket 200. The structure of the coating gun 120 is described in the context of the coating step.

The robot 400 includes a drive portion 410, a holding portion 420, an air supply source 430, two switching valves 443, 444 and three pressure regulating valves 445, 446, 447. The drive portion 410 may be formed of motors (not shown) which are operated in response to drive signals outputted from the controller 600. The holding portion 420 is connected to the bracket plate 111. A drive force is transmitted to the holding portion 420 from the motors used as the drive portion 410. Accordingly, the holding portion 420 may move the bracket plate 111 in a predetermined direction, and rotate the bracket plate 111. The holding portion 420 may be a general-use robot arm. Existing robot techniques are applicable to the robot 400. Accordingly, the principles of the present embodiment are not limited to a particular structure of the robot 400.

The air supply source 430 and the switching valves 443, 444 are used for operating the gun bracket 200. The air supply source 430 and the switching valves 443, 444 are described in the context of the coating step.

The controller 600 includes a storage 610, a data processor 620 and a signal generator 630. The aforementioned movement trajectory data is stored in the storage 610. In addition, the storage 610 stores a detection result outputted through the sensor controller 135. The data processor 620 corrects the movement trajectory data in the correction step to generate correction data. The aforementioned drive portion 410 operates the holding portion 420 and the applicator 101 on the basis of the correction data. In addition, the data processor 620 performs processes in the data processing step for determining whether or not the coating agent is appropriately applied with reference to the detection result acquired in the first and second detection steps.

The signal generator 630 generates signals for controlling the robot 400 and the coating gun 120. In addition, the signal generator 630 is electrically connected to the sensor controller 135 to control a shape detection process performed by the sensor device 130.

(Object)

Figure 2:
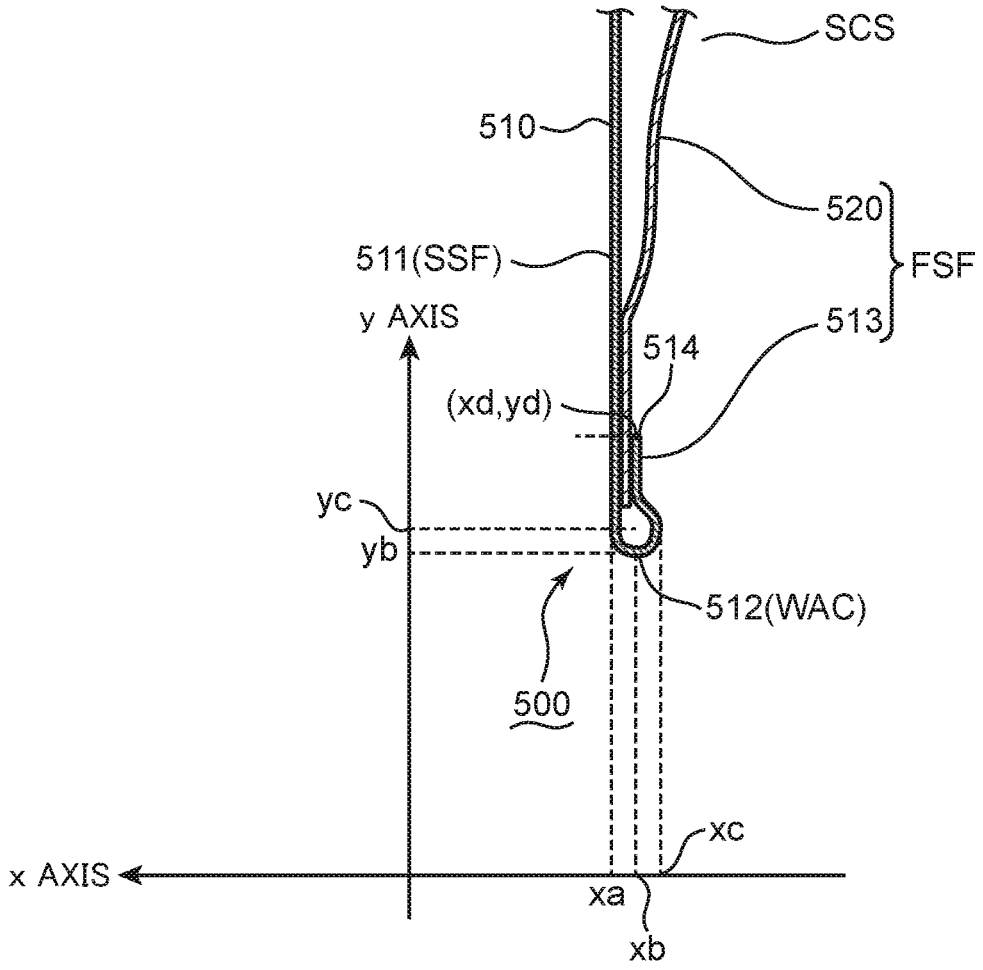
FIG. 2 is a schematic cross-sectional view of a hem portion.

FIG. 2 is a schematic cross-sectional view of a hem portion 500. The hem portion 500 is described with reference to FIG. 2.

With regard to the present embodiment, the hem portion 500 is exemplified as the aforementioned object. However, the object may have other structures. The principles of the present embodiment are not limited to a particular structure of the object.

With regard to the present embodiment, a sealing agent is applied to the hem portion 500 as the aforementioned coating agent. The hem portion 500 may be subjected to the rust prevention treatment by the sealing agent. However, the coating agent may be another agent (e.g. paint). The principles of the present embodiment are not limited to a particular material used as the coating agent.

The hem portion 500 includes an outer panel 510 and an inner panel 520. The outer panel 510 includes a main plate portion 511, and a hem strip 513 bent from the main plate portion 511 along a bent edge 512. The hem strip 513 includes a hem edge 514 extending along the bent edge 512 at a position away from the bent edge 512. The hem strip 513 forms a strip-like region between the bent edge 512 and the hem edge 514. The lower end portion of the inner panel 520 is sandwiched between the main plate portion 511 and the hem strip 513. The hem strip 513 forms a part of a first surface FSF to which the sealing agent is applied. The inner panel 520 forms the remaining region of the first surface FSF. The main plate portion 511 forms the second surface SSF opposite to the first surface FSF.

The sealing agent is applied along the hem edge 514 in the aforementioned coating step. Accordingly, liquid is less likely to flow into a boundary between the main plate portion 511 and the hem strip 513. Accordingly, the outer and inner panels 510, 520 are less likely to rust.

Figure 3:
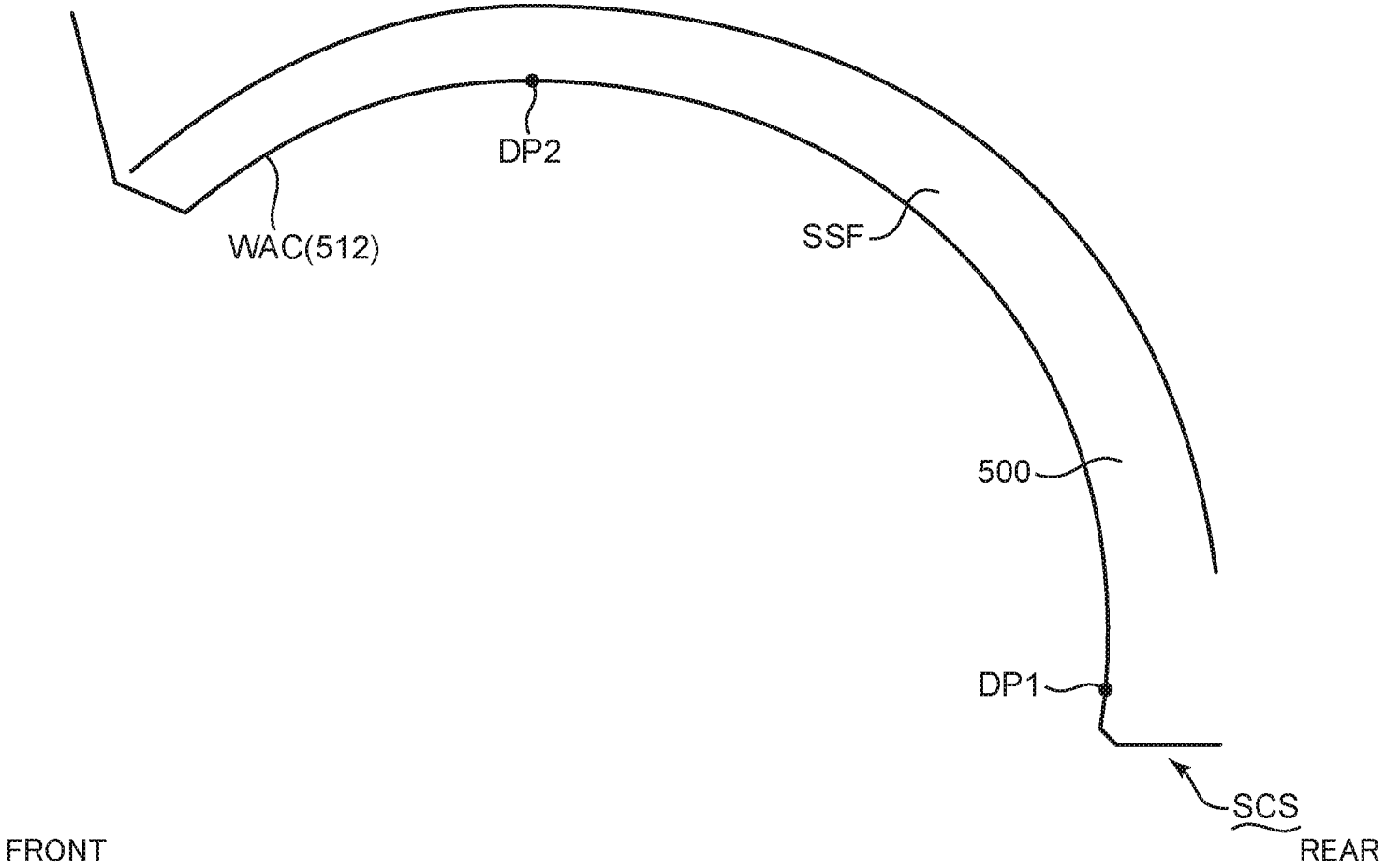
FIG. 3 is a schematic side view of a vehicle body.

FIG. 3 is a schematic side view of a vehicle body SCS. The hem portion 500 is further described with reference to FIGS. 2 and 3.

With regard to the present embodiment, the hem portion 500 described with reference to FIG. 2 forms a part of the rear fender of the vehicle body SCS. However, the hem portion 500 may form another part of the vehicle body SCS. The principles of the present embodiment are not limited to a particular portion of the vehicle body SCS at which the hem portion 500 is used.

The bent edge 512 described with reference to FIG. 2 forms the wheel arch WAC of the vehicle body SCS. The wheel arch WAC forms a profile of the rear fender. The second surface SSF described with reference to FIG. 2 corresponds to an outer surface of the rear fender. The hem edge 514 described with reference to FIG. 2 is curved along the wheel arch WAC.

(Correction Step)

The correction step is performed to make the movement trajectory data match an actual positional relationship between the robot 400 and the vehicle body SCS, the movement trajectory data indicating a movement trajectory of the connection portion between the holding portion 420 and the bracket plate 111 described with reference to FIG. 1 (c.f. FIG. 3). Accordingly, the detection result acquired in the first and second detection steps performed after the correction step may accurately indicate the shape of the vehicle body SCS. In addition, the sealing agent is accurately applied to the hem edge 514 (c.f. FIG. 2). The correction step is described with reference to FIGS. 1 to 3.

FIG. 3 shows two detection points DP1, DP2 positioned on the wheel arch WAC. The detection point DP1 is a coating start position at which the coating of the sealing agent is started. The detection point DP2 is positioned above and in front of the detection point DP1. The wheel arch WAC extends in a curved shape so that the wheel arch WAC extends through the detection points DP1, DP2. With regard to the present embodiment, the start point position is exemplified by the detection point DP1.

Figure 4:
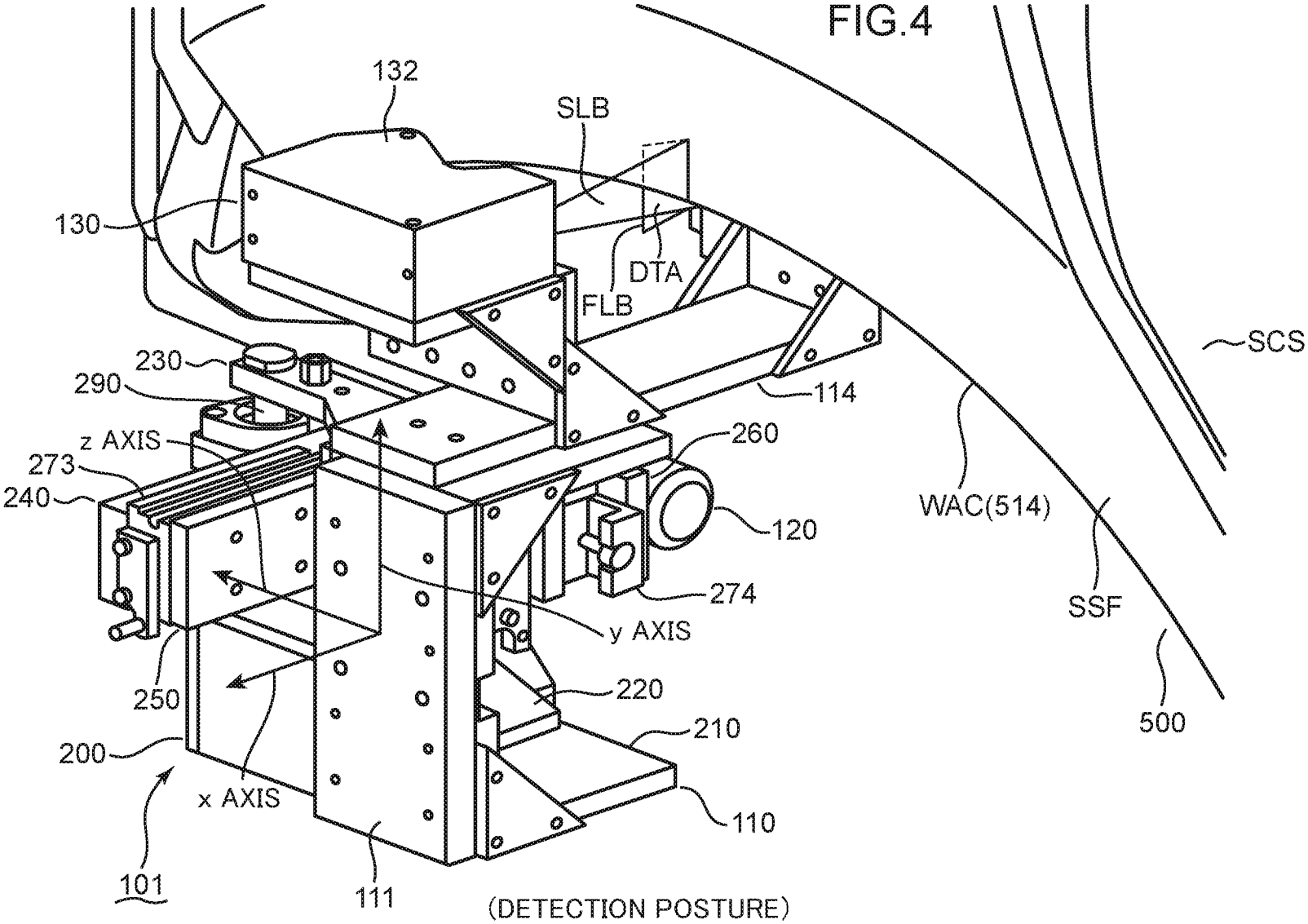
FIG. 4 is a schematic perspective view of an applicator shown in FIG. 1.

FIG. 4 is a schematic perspective view of the applicator 101. The applicator 101 is described with the reference to FIGS. 1, 2 and 4.

The applicator 101 shown in FIG. 4 is set at a posture which allows the sensor device 130 to detect the shapes and the positions of the first and second surfaces FSF, SSF described with reference to FIG. 2. The posture of the applicator 101 shown in FIG. 4 is referred to as "detection posture" in the following description.

The bracket plate 111, the sensor bracket 114 and the gun bracket 200 which are described with reference to FIG. 1 form the bracket 110 (c.f. FIG. 4). FIG. 4 shows an x axis, a y axis and a z axis. The x, y and z axes intersect with each other at one point on a surface of the bracket plate 111. The holding portion 420 described with reference to FIG. 1 is connected to the bracket 110 at the intersecting point of the x, y and z axes (hereinafter referred to as "coordinate origin"). The aforementioned movement trajectory data indicates a movement trajectory of the coordinate origin.

Figure 5:
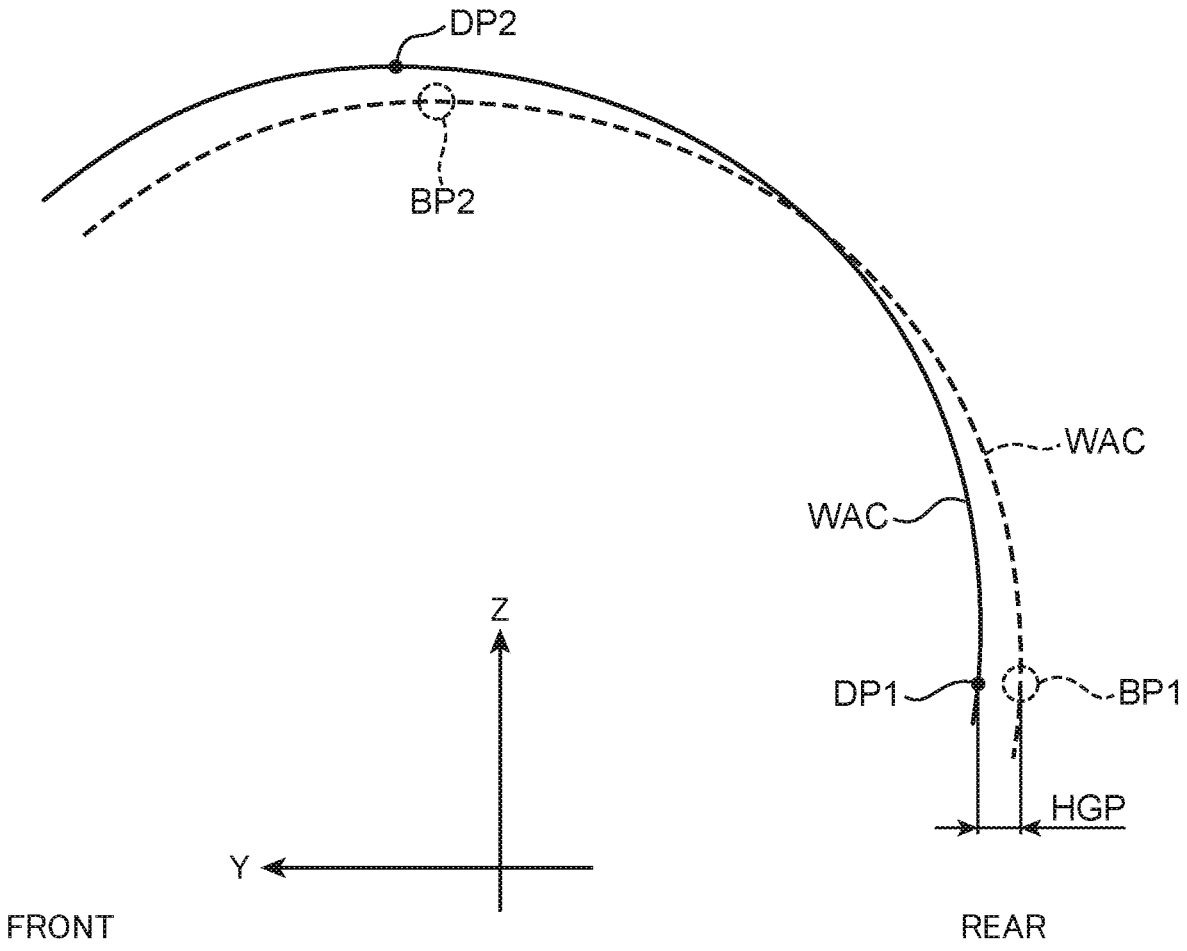
FIG. 5 is a conceptual view of a wheel arch of a vehicle body shown in FIG. 3.

FIG. 5 is a conceptual view of the wheel arch WAC. An exemplary operation of the coating device 100 is described with reference to FIGS. 1 to 5.

The solid line in FIG. 5 indicates an actual position of the wheel arch WAC. The dotted line in FIG. 5 indicates a position of the wheel arch WAC set in design. FIG. 5 indicates a first reference point BP1 and a second reference point BP2. The first and second reference points BP1, BP2 are positioned on the wheel arch WAC drawn by the dotted line. If the actual position of the wheel arch WAC is coincident to the position of the wheel arch WAC set in design, the first reference point BP1 is coincident to the detection point DP1 described with reference to FIG. 3 whereas the second reference point BP2 is coincident to the detection point DP2 described with reference to FIG. 3. The tangent line with respect to the wheel arch WAC at the first reference point BP1 extends substantially vertically. On the other hand, the tangent line with respect to the wheel arch WAC at the second reference point BP2 extends substantially horizontally. The storage 610 described with reference to FIG. 1 stores coordinate data indicating the positions of the first and second reference points BP1, BP2.

With regard to the present embodiment, the first sensor 131 (c.f. FIG. 1) is a laser sensor which faces the first surface FSF, and radiates a planar first laser beam FLB to the first surface FSF (c.f. FIG. 2). The first sensor 131 receives a reflection beam of the first laser beam FLB reflected on the first surface FSF, and generates electric signals indicating the position and the shape of the first surface FSF. The second sensor 132 is a laser sensor which radiates a planar second laser beam SLB to the second surface SSF. The second sensor 132 receives a reflection beam of the second laser beam SLB reflected on the second surface SSF, and generates electric signals indicating the position and the shape of the second surface SSF. The shapes of the first and second surfaces FSF. SSF are detected by using the first and second laser beams FLB, SLB. Accordingly, the detection result outputted to the controller 600 (c.f. FIG. 1) via the sensor controller 135 is less likely to be affected by ambient light around the sensor device 130. However, the positions and the shapes of the first and second surfaces FSF, SSF may be detected by using other detection techniques. Accordingly, the principles of the present embodiment are not limited to a particular sensor element used as the sensor device.

As shown in FIG. 4, when the first and second sensors 131, 132 respectively radiate the first and second laser beams FLB, SLB, the first laser beam FLB is overlapped to the second laser beam SLB to form a planar detection area DTA. When the applicator 101 is set at the detection posture, the vehicle body SCS around the wheel arch WAC is positioned between the first and second sensors 131, 132 to intersect with the detection area DTA. The wheel arch WAC is substantially orthogonal to the detection area DTA. Accordingly, the positions and the shapes of the first and second surfaces FSF, SSF are optically detected.

The following table conceptually indicates the movement trajectory data stored in the storage 610 (c.f. FIG. 1). The movement trajectory data in the following table indicates an imaginary curve preliminarily set in correspondence to an extending shape (i.e. arcuate curved shape) of the hem portion 500. The imaginary curve indicated by the movement trajectory data may be considered as a curve obtained by translating the curve of the wheel arch WAC drawn by the solid line in FIG. 5.

In the aforementioned table, the X axis coordinate value indicates the position of the coordinate origin on the X axis. In the aforementioned table, the Y axis coordinate value indicates the position of the coordinate origin on the Y axis. In the aforementioned table, the Z axis coordinate value indicates the position of the coordinate origin on the Z axis.

In the aforementioned table, the rotational angle θ indicates an angular position of the bracket 110 about the x axis. A value of the rotational angle θ is set so that the wheel arch WAC drawn by the dotted line in FIG. 5 is orthogonal to the detection area DTA at each of data points (data points 1 to N).

When the coordinate origin is situated at a position in correspondence to "data point 1" shown in the aforementioned table, the detection area DTA is overlapped to the first reference point BP1 shown in FIG. 5. When the coordinate origin is situated at a position in correspondence to "data point M" shown in the aforementioned table, the detection area DTA is overlapped to the second reference point BP2 shown in FIG. 5. The second reference point BP2 corresponds to the upper most point of the arcuate wheel arch WAC drawn by the dotted line in FIG. 5.

When the coordinate origin is situated at a position in correspondence to "data point 1" shown in the aforementioned table, the angular position of the bracket 110 is set at the value of "θ1". In this case, the detection area DTA is substantially horizontal. When the coordinate origin is situated at a position in correspondence to "data point M" shown in the aforementioned table, the angular position of the bracket 110 is set at the value of "θM". In this case, the detection area DTA is substantially vertical.

TABLE 1

MOVEMENT TRAJECTORY DATA

| DATA POINT | X COORDINATE VALUE | Y COORDINATE VALUE | Z COORDINATE VALUE | ROTATIONAL ANGLE θ | Pressure P | Coating amount A |
|---|---|---|---|---|---|---|
| DATA POINT 1 (COATING START POSITION) | X1 | Y1 | Z1 | θ1 | P1 | A1 |
| DATA POINT 2 | X1 | Y2 | Z2 | θ2 | P2 | A2 |
| . | . | . | . | . | . | . |
| . | . | . | . | . | . | . |
| . | . | . | . | . | . | . |
| DATA POINT M (SECOND REFERENCE POINT) | X1 | YM | ZM | θM | PM | AM |
| . | . | . | . | . | . | . |
| . | . | . | . | . | . | . |
| . | . | . | . | . | . | . |
| DATA POINT N (COATING END POSITION) | X1 | YN | ZN | θN | PN | AN |

M: NATURAL NUMBER
N: NATURAL NUMBER
N > M

The movement trajectory data in the aforementioned table is set by using a coordinate system fixedly set in a space in which the coating device 100 is situated (hereinafter referred to as the fixed coordinate). The x, y and z axes shown in FIG. 4 move and/or rotate in the fixed coordinate.

The fixed coordinate is a three-dimensional orthogonal coordinate defined by the X axis, the Y axis and the Z axis. The X axis is in parallel to the x axis shown in FIG. 4. The X axis extends in the width direction of the vehicle body SCS. The Y axis extends in the longitudinal direction of the vehicle body SCS. The Z axis extends in the vertical direction of the vehicle body SCS.

The detection area DTA is wide enough for the wheel arch WAC to intersect with the detection area DTA even when the wheel arch WAC is displaced from the position set in the design. Accordingly, the sensor device 130 may appropriately detect the position of the profile of the wheel arch WAC.

The signal generator 630 described with reference to FIG. 1 includes a first signal generator 631, a second signal generator 632 and a switching signal generator 634. The second signal generator 632 and the switching signal generator 634 are operated in the aforementioned coating step.

The second signal generator 632 and the switching signal generator 634 are described in the context of the coating step.

The data processor 620 includes a correction portion 621, an extractor 622, a comparison portion 623 and a determination portion 624. The extractor 622, the comparison portion 623 and the determination portion 624 are operated in the aforementioned data processing step. The extractor 622, the comparison portion 623 and the determination portion 624 are described in the context of the data processing step.

The first signal generator 631 reads out the movement trajectory data from the storage 610 to generate a drive signal for moving the coordinate origin to the coordinate position indicated by "data point 1" in the aforementioned table. In this case, the rotational angle θ is set at "θ1", so that the profile of the wheel arch WAC existing at a position displaced from the first reference point BP1 in the horizontal direction may be detected in the detection area DTA. The detection point DP1 described with reference to FIG. 3 corresponds to an intersecting point between the detection area DTA and the wheel arch WAC when the coordinate origin is situated at the position in correspondence to "data point 1". The detection result acquired when the coordinate origin is situated at the position in correspondence to "data point 1" is transmitted from the sensor device 130 to the storage 610.

From the storage 610, the correction portion 621 reads out the aforementioned movement trajectory data, coordinate data indicating the position of the first reference point BP1, coordinate data indicating the position of the detection point DP1 (i.e. the detection result acquired when the coordinate origin is situated at "data point 1"). The correction portion 621 compares a Y coordinate value of the coordinate data indicating the position of the detection point DP1 with the Y coordinate value of coordinate data indicating the position of the first reference point BP1, and calculates the horizontal displacement HGP (c.f. FIG. 5) of the wheel arch WAC. The horizontal displacement HGP may take a positive or negative value. A symbol of the horizontal displacement HGP is dependent on whether the wheel arch WAC is displaced in the frontward or rearward direction. The correction portion 621 corrects the movement trajectory data using the calculated displacement HGP to generate the first correction data. The following table conceptually indicates the first correction data.

TABLE 2

FIRST CORRECTION DATA

| DATA POINT | X COORDINATE VALUE | Y COORDINATE VALUE | Z COORDINATE VALUE | ROTATIONAL ANGLE θ | Pressure P | Coating amount A |
|---|---|---|---|---|---|---|
| DATA POINT 1 (COATING START POSITION) | X1 | Y1 + HGP | Z1 | θ1 | P1 | A1 |
| DATA POINT 2 | X1 | Y2 + HGP | Z2 | θ2 | P2 | A2 |
| . | . | . | . | . | . | . |
| . | . | . | . | . | . | . |
| . | . | . | . | . | . | . |
| DATA POINT M (SECOND REFERENCE POINT) | X1 | YM + HGP | ZM | θM | PM | AM |
| . | . | . | . | . | . | . |
| . | . | . | . | . | . | . |
| . | . | . | . | . | . | . |
| DATA POINT N (COATING END POSITION) | X1 | YN + HGP | ZN | θN | PN | AN |

M: NATURAL NUMBER

N: NATURAL NUMBER

N > M

Figure 6:
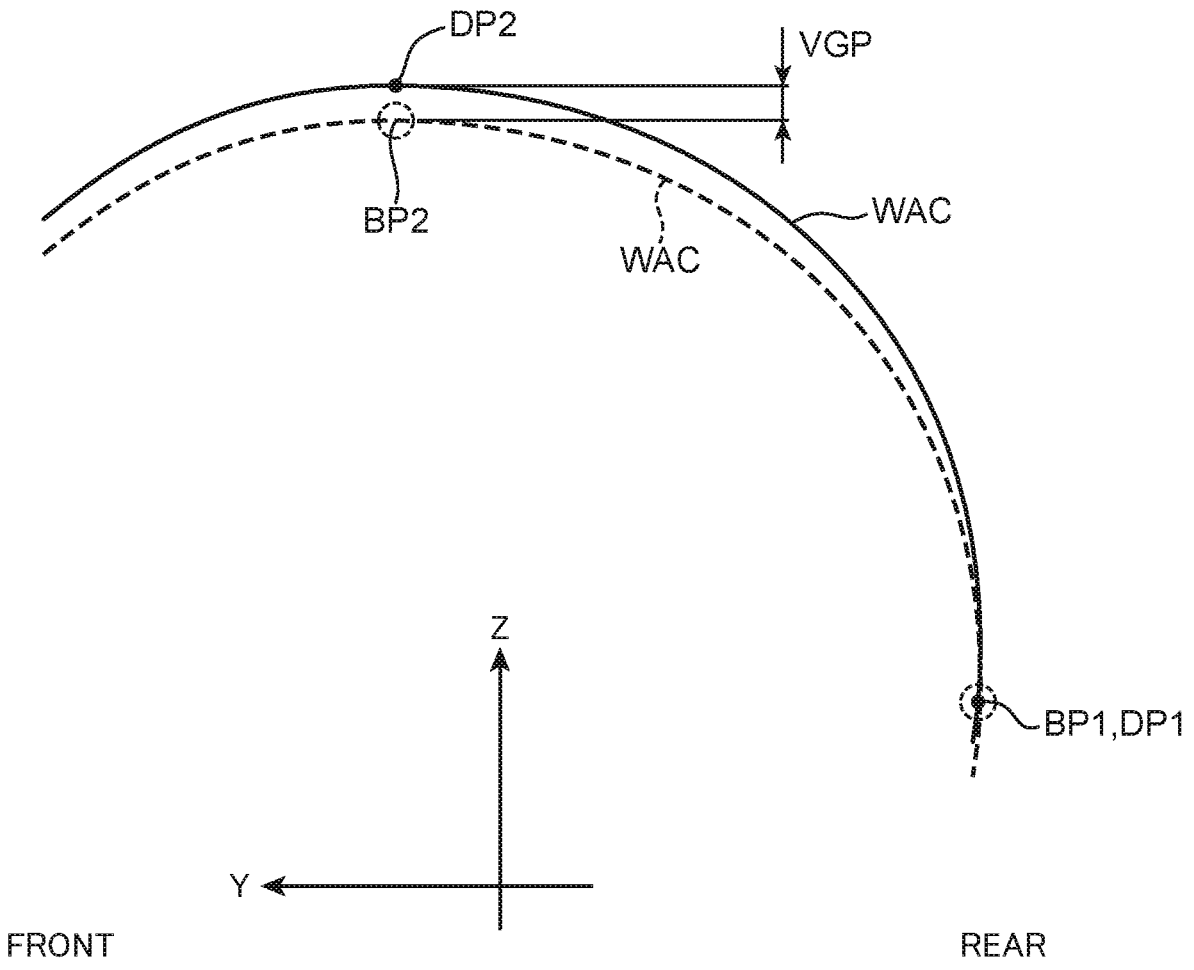
FIG. 6 is the conceptual view of the wheel arch of the vehicle body shown in FIG. 3.

FIG. 6 is a conceptual view of the wheel arch WAC. An exemplary operation of the coating device 100 is described with reference to FIGS. 1 to 6.

The solid line in FIG. 6 indicates an actual position of the wheel arch WAC. The dotted line in FIG. 6 corresponds to the dotted line in FIG. 5. The wheel arch WAC, the first and second reference points BP1, BP2, which are indicated by the dotted line in FIG. 6, move frontward from the positions of the wheel arch WAC, the first and second reference points BP1, BP2, which are indicated by the dotted line in FIG. 5, by an amount of the horizontal displacement HGP respectively. Accordingly, the position of the first reference point BP1 in FIG. 6 is coincident to the detection point DP1 in FIG. 6. The second reference point BP2 shown in FIG. 6 is indicated at a position acquired by adding the horizontal displacement HGP to the Y coordinate value of coordinate data indicating the position of the second reference point BP2 in FIG. 5.

the position of the detection point DP2 with the Z coordinate value of coordinate data indicating the position of the second reference point BP2 in FIG. 6, and calculates the vertical displacement VGP (c.f. FIG. 6) of the wheel arch WAC. The vertical displacement VGP may take a positive or negative value. A symbol of the vertical displacement VGP is dependent on whether the wheel arch WAC is displaced in the upward or downward direction. The correction portion 621 corrects the first correction data using the calculated displacement VGP to generate second correction data. As the result of generating the second correction data, the wheel arch WAC, the first and second reference points BP1, BP2 which are indicated by the dotted line in FIG. 6 move upward by an amount of the vertical displacement VGP. The second correction data is outputted from the correction portion 621 to the storage 610. The storage 610 stores the second correction data. The following table conceptually indicates the second correction data.

TABLE 3

SECOND CORRECTION DATA

| DATA POINT | X COORDINATE VALUE | Y COORDINATE VALUE | Z COORDINATE VALUE | ROTATIONAL ANGLE θ | Pressure P | Coating amount A |
|---|---|---|---|---|---|---|
| DATA POINT 1 (COATING START POSITION) | X1 | Y1 + HGP | Z1 + VGP | θ1 | P1 | A1 |
| DATA POINT 2 | X1 | Y2 + HGP | Z2 + VGP | θ2 | P2 | A2 |
| . | . | . | . | . | . | . |
| . | . | . | . | . | . | . |
| . | . | . | . | . | . | . |
| DATA POINT M (SECOND REFERENCE POINT) | X1 | YM + HGP | ZM + VGP | θM | PM | AM |
| . | . | . | . | . | . | . |
| . | . | . | . | . | . | . |
| . | . | . | . | . | . | . |
| DATA POINT N (COATING END POSITION) | X1 | YN + HGP | ZN + VGP | θN | PN | AN |

M: NATURAL NUMBER
N: NATURAL NUMBER
N > M

The first correction data is outputted from the correction portion 621 to the storage 610. The first signal generator 631 reads out the first correction data from the storage 610 to generate a drive signal for moving the coordinate origin to the coordinate position indicated by "data point M" which the first correction data indicates. In this case, the rotational angle θ is set at "θM", so that the profile of the wheel arch WAC existing at a position displaced from the second reference point BP2 in the vertical direction may be detected in the detection area DTA (c.f. FIG. 4). The detection point DP2 described with reference to FIG. 3 corresponds to an intersecting point between the detection area DTA and the wheel arch WAC when the coordinate origin is situated at the position in correspondence to "data point M" indicated by the first correction data. The detection result acquired when the coordinate origin is situated at the position in correspondence to "data point M" is transmitted from the sensor device 130 to the storage 610.

From the storage 610, the correction portion 621 reads out the first correction data, coordinate data indicating the position of the second reference point BP2, coordinate data indicating the position of the detection point DP2 (i.e. the detection result acquired when the coordinate origin is situated at "data point M"). The correction portion 621 compares a Z coordinate value of coordinate data indicating As the result of a series of the aforementioned correction steps, the horizontal displacement HGP is added to the Y coordinate value of the preset movement trajectory data (c.f. Table 1) whereas the vertical displacement VGP is added to the Z coordinate value of the preset movement trajectory data. Accordingly, when the coordinate origin is moved along the movement trajectory indicated by the second correction data, the detection area DTA may move along the wheel arch WAC so that the wheel arch WAC intersects with the detection area DTA substantially at a fixed position in the detection area DTA.

The coordinate indicated by "data point 1" of the second correction data is set as the coordinate position for arranging the coating gun 120 at the coating start position. The coordinate indicated by "data point N" of the second correction data is set as the coordinate position for arranging the coating gun 120 at the coating end position at which the coating of the sealing agent is finished. Alternatively, the coordinate indicated by "data point 1" of the second correction data may be defined as the coordinate position for allowing the coating gun 120 to face one end of the hem edge 514. The coordinate indicated by "data point N" of the second correction data may be defined as the coordinate position for allowing the coating gun 120 to face the other end of the hem edge 514.

When the coating step is started, the robot 400 rotates the bracket 110 about the x axis by substantially 90° to change the applicator 101 from the detection posture to a coating posture for applying the sealing agent. Then, the coordinate origin is set at the position in correspondence to the coordinate indicated by "data point 1" of the second correction data. In accordance with the second correction data, the robot 400 moves the coordinate origin from the position in correspondence to the coordinate indicated by "data point 1" in the second correction data to the position in correspondence to the coordinate indicated by "data point N" in the second correction data under a control of the controller 600. Accordingly, the sealing agent is applied to cover the hem edge 514 (c.f. FIG. 2) over the coating zone from the coating start position to the coating end position.

When the first and second detection steps are started, the coordinate origin is set at the position in correspondence to the coordinate indicated by "data point 1" of the second correction data. In accordance with the second correction data, the robot 400 moves the coordinate origin from the position in correspondence to the coordinate indicated by "data point 1" in the second correction data to the position in correspondence to the coordinate indicated by "data point N" in the second correction data under a control of the controller 600. Accordingly, the detection area DTA which is formed by the applicator 101 set in the detection posture scans the hem portion 500 over the coating zone from the coating start position to the coating end position. Consequently, during the first and second detection steps, the positions and the shapes of the first and second surfaces FSF, SSF are detected over the coating zone. With regard to the present embodiment, the end point position is exemplified by the coating position of the sealing agent and/or the position of the detection area DTA when the coordinate origin is set at the position in correspondence to the coordinate indicated by "data point N". The zone information is exemplified by the second correction data.

Figure 7:
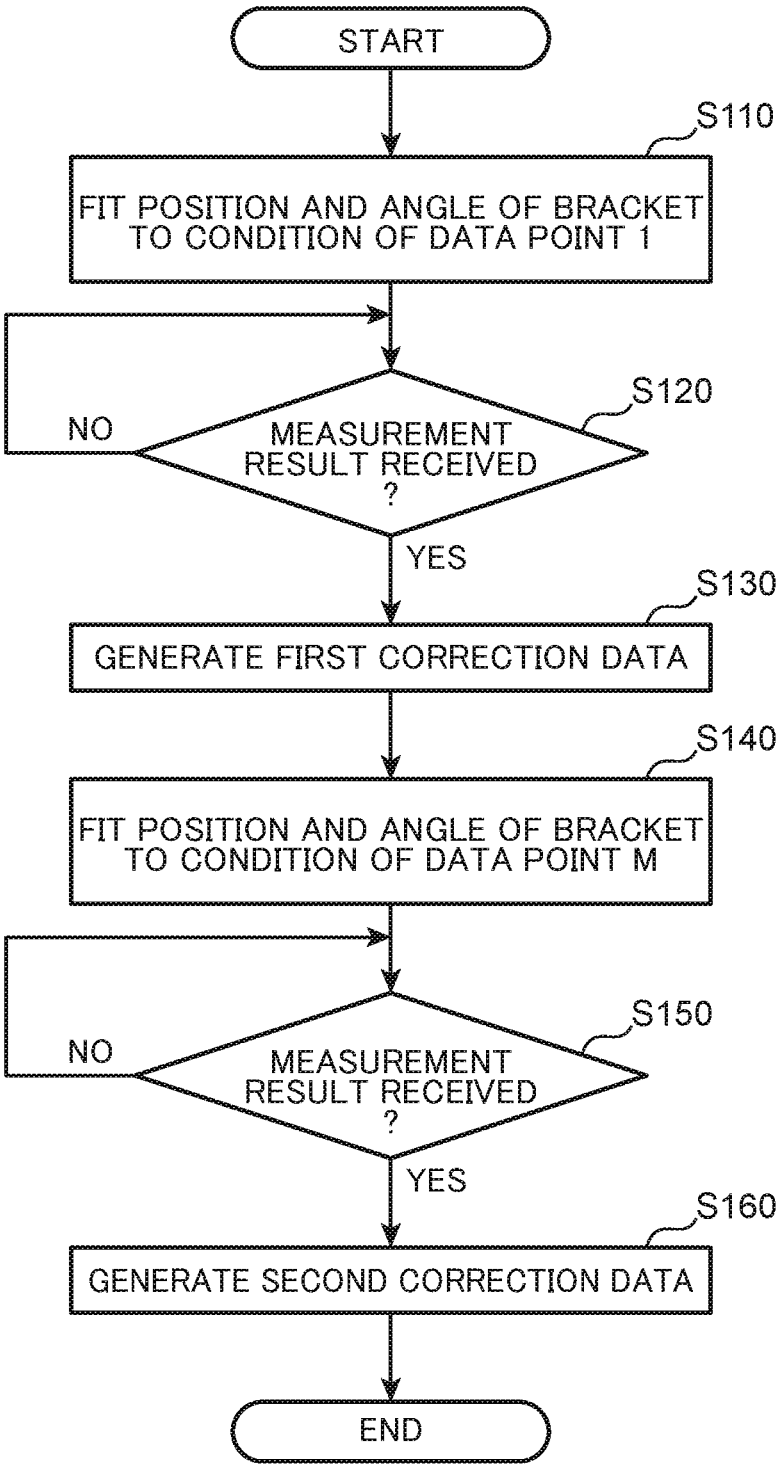
FIG. 7 is a schematic flowchart showing a correction step of a controller of the coating device shown in FIG. 1.

FIG. 7 is a schematic flowchart showing the correction step of the controller 600. The correction step of the controller 600 is described with reference to FIGS. 1, 2, 4 to 7.

(Step S110)

The first signal generator 631 reads out the movement trajectory data from the storage 610. The first signal generator 631 generates a drive signal with reference to information associated with the data point 1 of the movement trajectory data. The drive signal is outputted from the first signal generator 631 to the drive portion 410. The drive portion 410 moves the holding portion 420 in response to the drive signal. Accordingly, the position of the bracket 110 (i.e. the position of the coordinate origin) is set at the position (X1, Y1, Z1) in the fixed coordinate associated with the data point 1 of the movement trajectory data. The angle of the bracket 110 is set to the angle "θ1" associated with the data point 1 of the movement trajectory data. In this case, the detection area DTA formed by the sensor device 130 intersects with the wheel arch WAC at the first reference point BP1. When the position and the angle of the bracket 110 meet the condition associated with the data point 1, step S120 is performed.

(Step S120)

The controller 600 waits for a detection result (i.e. information indicating a position of the wheel arch WAC detected at the first reference point BP1) from the sensor device 130. When the controller 600 receives the detection result from the sensor device 130, step S130 is performed.

(Step S130)

The detection result from the sensor device 130 is stored in the storage 610. The correction portion 621 reads out the movement trajectory data, the coordinate data indicating the position of the first reference point BP1, and the detection result from the sensor device 130 from the storage 610. The correction portion 621 compares a Y coordinate value indicated by the detection result from the sensor device 130 with the Y coordinate value of the coordinate data indicating the position of the first reference point BP1, and calculates the horizontal displacement HGP. For example, the correction portion 621 may use the following formula for calculating the horizontal displacement HGP.

$$HGP = Y_{base} - Y_{result} \quad \text{[Formula 1]}$$

HGP: HORIZONTAL DISPLACEMENT $Y_{base}$: Y COORDINATE VALUE OF COORDINATE DATA INDICATING POSITION OF FIRST REFERENCE POINT $Y_{result}$: Y COORDINATE VALUE INDICATED BY MEASURED RESULT The correction portion 621 generates the first correction data by adding the calculated horizontal displacement HGP to the Y coordinate value of the movement trajectory data. The first correction data is outputted from the correction portion 621 to the storage 610. The storage 610 stores the first correction data. Then, step S140 is performed.

(Step S140)

The first signal generator 631 reads out the first correction data from the storage 610. The first signal generator 631 generates a drive signal with reference to information associated with the data point M of the first correction data. The drive signal is outputted from the first signal generator 631 to the drive portion 410. The drive portion 410 moves the holding portion 420 in response to the drive signal. Accordingly, the position of the bracket 110 (i.e. the position of the coordinate origin) is set at the position (XM, YM, ZM) in the fixed coordinate associated with the data point M of the first correction data. The angle of the bracket 110 is set to the angle "θM" associated with the data point M of the first correction data. In this case, the detection area DTA formed by the sensor device 130 intersects with the wheel arch WAC at the second reference point BP2 shown in FIG. 6. When the position and the angle of the bracket 110 meet the condition associated with the data point M, step S150 is performed.

(Step S150)

The controller 600 waits for a detection result from the sensor device 130 (i.e. information indicating a position of the wheel arch WAC detected at the second reference point BP2). When the controller 600 receives the detection result from the sensor device 130, step S160 is performed.

(Step S160)

The detection result from the sensor device 130 is stored in the storage 610. From the storage 610, the correction portion 621 reads out the first correction data, the coordinate data indicating the position of the second reference point BP2, and the detection result from the sensor device 130. The correction portion 621 compares a Z coordinate value indicated by the detection result from the sensor device 130 with the Z coordinate value of the coordinate data indicating the position of the second reference point BP2, and calculates the vertical displacement VGP. For example, the correction portion 621 may use the following formula for the calculation of the vertical displacement VGP.

$$VGP = Z_{base} - Z_{result} \quad \text{[Formula 2]}$$

VGP: VERTICAL DISPLACEMENT $Z_{base}$: Z COORDINATE VALUE OF COORDINATE DATA INDICATING POSITION OF SECOND REFERENCE POINT $Z_{result}$: Z COORDINATE VALUE INDICATED BY MEASURED RESULT The correction portion 621 generates the second correction data by adding the calculated vertical displacement VGP to the Z coordinate value of the first correction data. The second correction data is outputted from the correction portion 621 to the storage 610. The storage 610 stores the second correction data so that the correction step is completed.

(First Detection Step)

The first detection step is performed to detect the shapes of the first and second surfaces FSF, SSF before the sealing agent is applied over the coating zone. In the first detection step, a change in position of the hem edge 514 (e.g. a change in distance from the wheel arch WAC to the hem edge 514) may be detected. Data indicating the position of the hem edge 514 detected in the first detection step may be used for controlling the position of the coating gun 120.

Figure 8:
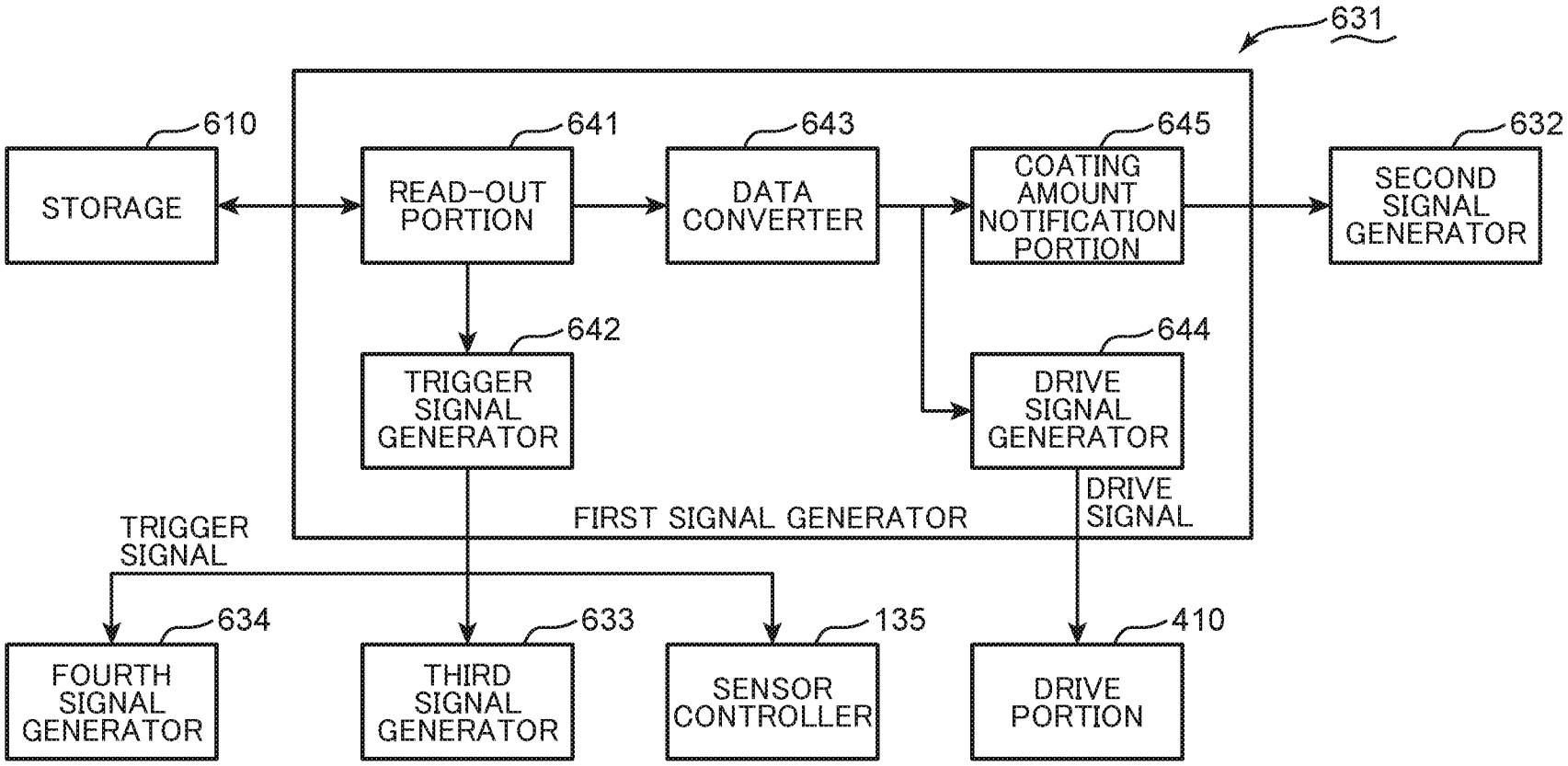
FIG. 8 is a schematic block diagram of a first signal generator of the coating device shown in FIG. 1.

FIG. 8 is a schematic block diagram of the first signal generator 631. The first signal generator 631 is described with reference to FIGS. 1, 2, 4 and 8.

The first signal generator 631 includes a read-out portion 641, a trigger signal generator 642, a data converter 643, a drive signal generator 644 and a coating amount notification portion 645. The coating amount notification portion 645 is operated in the coating step. The coating amount notification portion 645 is described in the context of the coating step.

In the first detection step, the read-out portion 641 reads out the aforementioned second correction data from the storage 610. The second correction data is outputted from the read-out portion 641 to the data converter 643. The data converter 643 directly outputs the second correction data to the drive signal generator 644 in the first detection step. On the other hand, in the coating step, the data converter 643 performs data conversion process for changing the posture of the applicator 101 from the detection posture described with reference to FIG. 4 to the coating posture for applying the sealing agent. The data conversion process is described in the context of the coating step.

The drive signal generator 644 generates a drive signal with reference to the second correction data. The drive signal is outputted from the drive signal generator 644 to the drive portion 410. The drive portion 410 drives the holding portion 420 in response to the drive signal. Accordingly, the coordinate origin (i.e. the connection point between the holding portion 420 and the bracket plate 111) may be moved continuously in accordance with the fixed coordinate determined by the second correction data. During such movement of the coordinate origin, the detection area DTA continuously scans the first and second surfaces FSF, SSF from the coating start position to the coating end position. The drive portion 410 generates movement data indicating a movement amount of the holding portion 420. The movement data is outputted from the drive portion 410 to the storage 610.

The read-out portion 641 notifies the trigger signal generator 642 of the completion of reading out the second correction data from the storage 610. The trigger signal generator 642 generates a trigger signal in response to the notification from the read-out portion 641. In the first detection step, the trigger signal is outputted from the trigger signal generator 642 to the sensor controller 135. In the coating step, the trigger signal is outputted from the trigger signal generator 642 to the sensor controller 135 and the switching signal generator 634. The sensor controller 135 outputs a detection result acquired from the first and second sensors 131, 132 in response to the trigger signal. The detection result is outputted from the sensor controller 135 to the storage 610 in response to the trigger signal, so that the storage 610 may receive the detection result in synchronism with the aforementioned movement data. Accordingly, the storage 610 may store the detection result in association with the movement data. With regard to the present embodiment, the first detection data is exemplified by the detection result outputted from the sensor controller 135 to the storage 610 in the first detection step.

FIG. 2 shows the x and y axes. The position of the second surface SSF is detected by the second sensor 132. The second surface SSF is substantially orthogonal to the x axis, so that the position of the second surface SSF may be expressed by a coordinate point on the x axis. In FIG. 2, the position of the second surface SSF is expressed by the coordinate point "xa" on the x axis. A boundary between an area in which the first and second sensors 131, 132 receive the reflection light of the first and second laser beams FLB, SLB and an area in which the first and second sensors 131, 132 do not receive the reflection light may be recognized as the position of the bent edge 512 (i.e. the wheel arch WAC). In FIG. 2, the position of the bent edge 512 is indicated by the coordinate point (xb, yb) on the x-y coordinate. When the outer panel 510 is bent appropriately along the bent edge 512 so that the hem edge 514 is brought into contact with the inner panel 520, a maximum thickness portion of the hem portion 500 is formed near the bent edge 512. In this case, the maximum thickness portion may be recognized as the position at which the difference between the position of the first surface FSF on the x axis detected by the first sensor 131 and the position of the second surface SSF on the x axis detected by the second sensor 132 becomes the maximum. In FIG. 2, the maximum thickness portion is indicated by the coordinate point (xc, yc) on the x-y coordinate. The position of the hem edge 514 may be recognized as a point at which the position of the first surface FSF on the x axis detected by the first sensor 131 is changed in the form of a step function. In FIG. 2, the position of the hem edge 514 is indicated by the coordinate point (xd, yd) on the x-y coordinate. The sensor controller 135 may generate data necessary for performing the data processing step as a detection result (e.g. the positions of the second surface SSF, the bent edge 512, the maximum thickness portion and the hem edge 514) on the basis of electric signals which the sensor controller 135 receives from the first and second sensors 131, 132.

After the detection area DTA scans the first and second surfaces FSF, SSF from the coating start position to the coating end position, the correction portion 621 reads out the movement data and the detection result. The correction portion 621 may make the detection result correspond to the data points 1 to N with reference to the movement data and data of the rotational angle θ in the second correction data. The correction portion 621 may adjust a value of a pressure P in the second correction data with reference to the position of the hem edge 514 indicated by the detection result. In addition, the correction portion 621 may adjust a fixed coordinate value (X, Y, Z) in the second correction data with reference to the bent edge 512 (i.e. the position of the wheel arch WAC) indicated by the detection result. In the coating step, values of the pressure P in the second correction data are used for determining the position of the coating gun 120 in the extending direction of the y axis. After the values of the pressure P are determined for the data points 1 to N, the second correction data is outputted from the correction portion 621 to the storage 610.

(Coating Step)

The sealing agent is applied in the coating step. During applying the sealing agent, the gun bracket 200 is moved from the coating start position to the coating end position with being brought into contact with the second surface SSF and the wheel arch WAC. Even when actual shapes of the second surface SSF and the wheel arch WAC are deviated from the shapes in design, the gun bracket 200 may move with reflecting the deviation between the actual shapes and the shapes in design. Accordingly, even when the detection of the shape in the first detection step is not so accurately performed, the sealing agent may be accurately applied along the hem edge 514.

Figure 9:
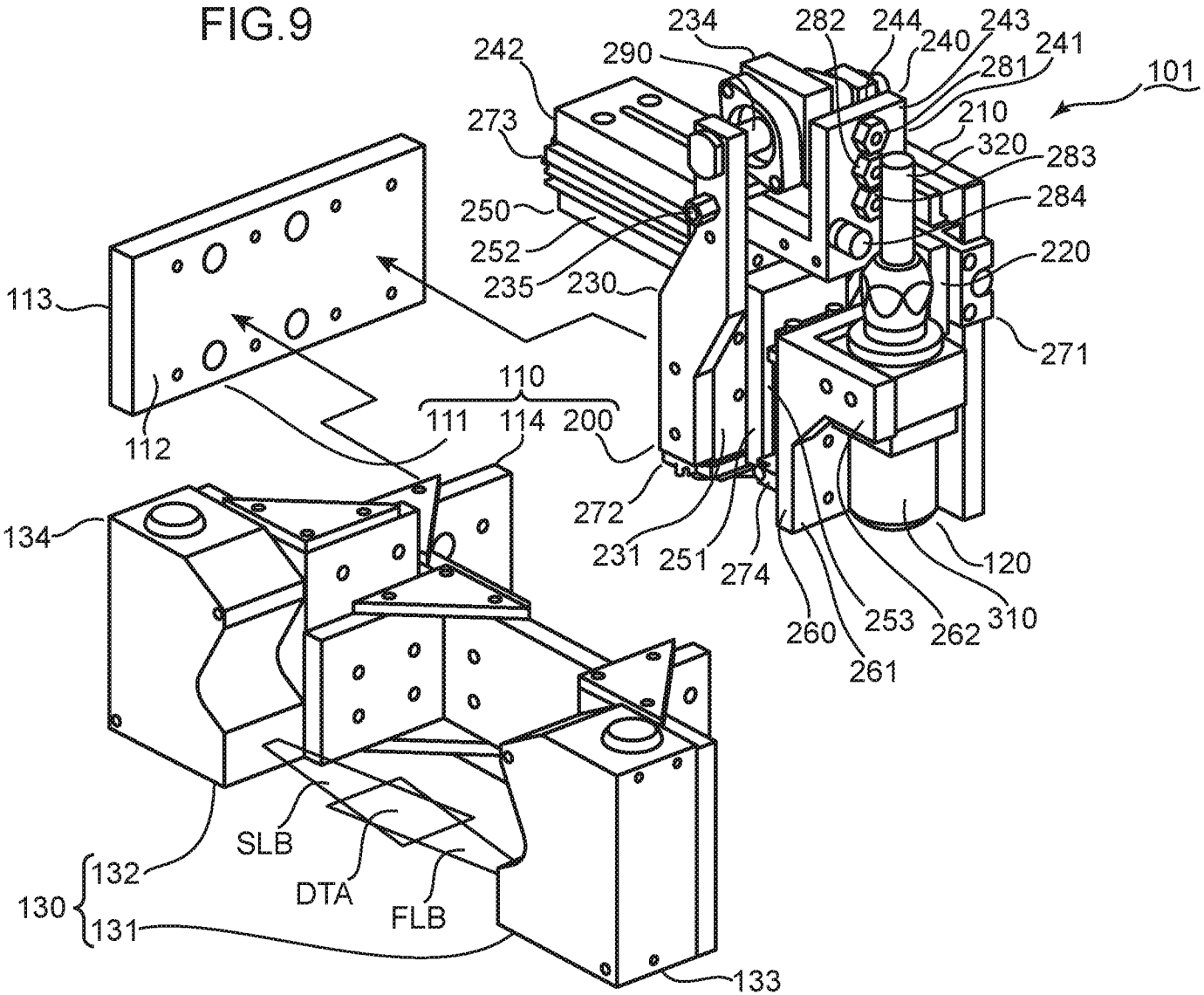
FIG. 9 is a schematic exploded perspective view of the applicator shown in FIG. 4.

FIG. 9 is a schematic exploded perspective view of the applicator 101. The applicator 101 is described with reference to FIGS. 1, 2 and 9.

The bracket plate 111 includes a right surface 112 and a left surface 113 opposite to the right surface 112. The holding portion 420 described with reference to FIG. 1 is connected to the left surface 113. The aforementioned coordinate origin may be defined as a point on the left surface 113. The gun bracket 200 and the sensor bracket 114 are fixed to the right surface 112 of the bracket plate 111. The gun bracket 200 and the sensor bracket 114 are aligned on the right surface 112 of the bracket plate 111. The coating gun 120 is mounted on the gun bracket 200. The sensor device 130 is mounted on the sensor bracket 114. Accordingly, the bracket 110, the coating gun 120 and the sensor device 130 are held by the robot 400.

As described above, the robot 400 may change the angular position of the bracket 110. When the robot 400 rotates the bracket 110 substantially by 90° from the detection posture, the applicator 101 is set to the coating posture in which the applicator 101 faces the first surface FSF. In this case, the coating gun 120 may apply the sealing agent to the hem edge 514.

The first sensor 131 includes a sensor housing 133. Various optical parts such as an oscillator configured to oscillate the first laser beam FLB and an optical receiver configured to receive a reflection light (not shown) reflected on the first surface FSF and generate an electric signal are stored in the sensor housing 133. Likewise, the second sensor 132 includes a sensor housing 134. Various optical parts such as an oscillator configured to oscillate the second laser beam SLB and an optical receiver configured to receive a reflection light (not shown) reflected on the second surface SSF and generate an electric signal are stored in the sensor housing 134. The sensor controller 135 may be stored in one or both of the sensor housings 133, 134, or may be an apparatus situated outside the sensor housings 133, 134.

Figure 10:
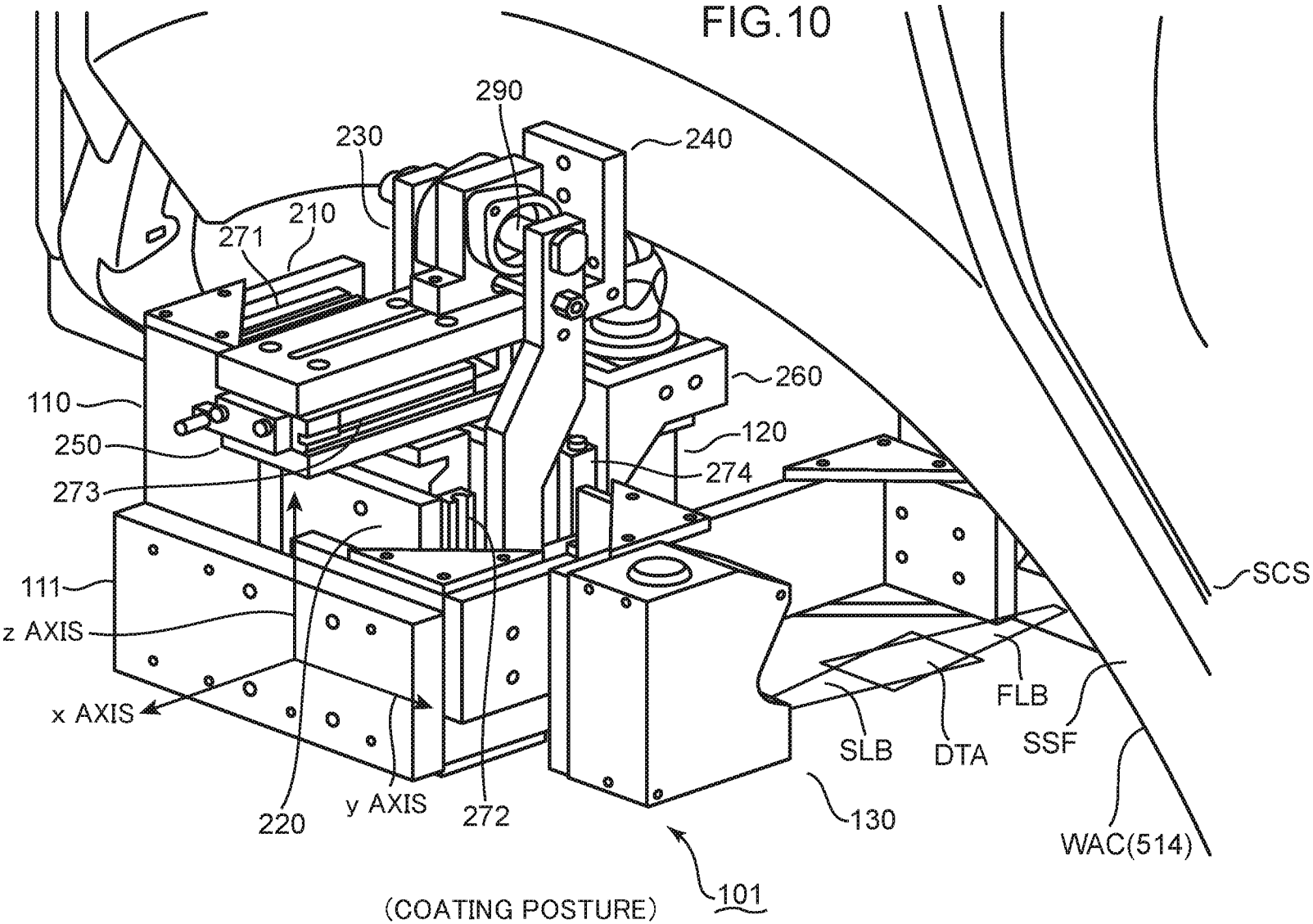
FIG. 10 is a schematic perspective view of the applicator shown in FIG. 4.

FIG. 10 is a schematic perspective view of the applicator 101. The applicator 101 is further described with reference to FIGS. 1, 2, 4, 8 to 10.

As shown in FIG. 9, the gun bracket 200 includes six bracket members 210, 220, 230, 240, 250, 260, four guide sliders 271, 272, 273, 274, three ball rollers 281, 282, 283, a guide roller 284 and a swing shaft portion 290.

Like FIG. 4, FIG. 10 shows the x, y and z axes. The direction of the x axis shown in FIG. 4 is coincident to the direction of the x axis shown in FIG. 10. The direction of the y axis shown in FIG. 4 is coincident to the direction of the z axis shown in FIG. 10. In short, FIGS. 4 and 10 show that the robot 400 rotates the bracket plate 111 by 90° about the x axis. FIG. 10 shows the coating posture of the applicator 101.

When the coating step is started, the read-out portion 641 reads out the second correction data from the storage 610. The second correction data is outputted from the read-out portion 641 to the data converter 643. The data converter 643 performs a process of adding "90°" to the rotational angle θ which the second correction data indicates. The second correction data after the adding process is outputted from the data converter 643 to the drive signal generator 644 and the coating amount notification portion 645. The following table indicates the second correction data after the adding process.

TABLE 4

SECOND CORRECTION DATA (AFTER ADDING PROCESS)

| DATA POINT | X COORDINATE VALUE | Y COORDINATE VALUE | Z COORDINATE VALUE | ROTATIONAL ANGLE θ | Pressure P | Coating amount A |
|---|---|---|---|---|---|---|
| DATA POINT 1 (COATING START POSITION) | X1 | Y1 + HGP | Z1 + VGP | θ1 + 90° | P1 | A1 |
| DATA POINT 2 | X1 | Y2 + HGP | Z2 + VGP | θ2 + 90° | P2 | A2 |
| . | . | . | . | . | . | . |
| . | . | . | . | . | . | . |
| . | . | . | . | . | . | . |
| DATA POINT M (SECOND REFERENCE POINT) | X1 | YM + HGP | ZM + VGP | θM + 90° | PM | AM |
| . | . | . | . | . | . | . |
| . | . | . | . | . | . | . |
| . | . | . | . | . | . | . |
| DATA POINT N (COATING END POSITION) | X1 | YN + HGP | ZN + VGP | θN 90° | PN | AN |

M: NATURAL NUMBER
N: NATURAL NUMBER
N > M

The drive signal generator 644 generates a drive signal with reference to data about the fixed coordinate value of the second correction data (X coordinate value, Y coordinate value, and Z coordinate value) and data about the rotational angle θ. The drive signal is outputted from the drive signal generator 644 to the drive portion 410. The coating amount notification portion 645 notifies the second signal generator 632 of a coating amount associated with a target data point with reference to data about the coating amount A of the second correction data. The drive signal generator 644 and the coating amount notification portion 645 are operated synchronously. Accordingly, the applicator 101 is controlled to achieve conditions with respective data points (data points 1 to N).

When the coating amount information indicating a coating amount is transmitted from the coating amount notification portion 645 to the second signal generator 632, the second signal generator 632 generates a gun control signal in response to the coating amount information. The gun control signal is outputted from the second signal generator 632 to the coating gun 120. Accordingly, the coating gun 120 may discharge an amount of the sealing agent designated by the coating amount information at each data point.

The switching signal generator 634 executes a predetermined program in response to the trigger signal to control the switching valves 443, 444. When the air is supplied to the guide slider 271 through the pressure regulating valve 445, the guide slider 271 pushes out the bracket member 220 rightward with a given force. When the air is supplied to the guide slider 272 through the pressure regulating valve 446, the guide slider 272 pushes out the bracket member 230 upward with a given force. The switching valve 443 opens an air transmission path to the guide sliders 273, 274 or closes the air transmission path under a control of the switching signal generator 634. When the air is supplied from the switching valve 443 to the guide slider 273 through the pressure regulating valve 447, the guide slider 273 moves the bracket member 250 leftward with a given force. When the air is supplied to the guide slider 274 from the switching valve 444, the applicator 101 is held by the guide slider 274 with a given force in the extending direction of the z axis.

Figure 11:
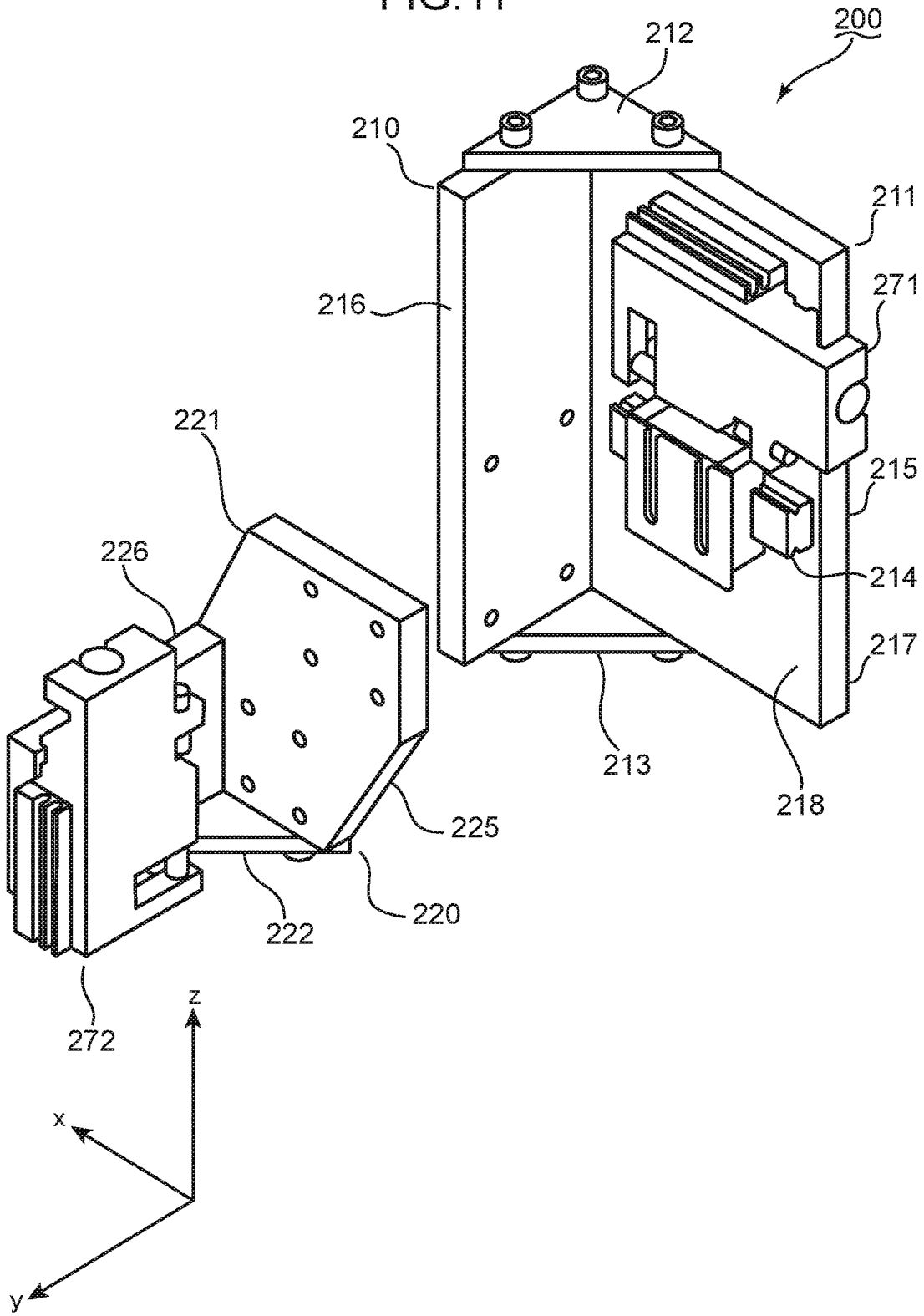
FIG. 11 is an exploded perspective view of a part of a gun bracket of the applicator shown in FIG. 4.

FIG. 11 is an exploded perspective view of a part of the gun bracket 200. The gun bracket 200 is described with reference to FIGS. 9 and 11.

The bracket member 210 includes a bracket plate 211, two reinforcing plates 212, 213 and a linear guide 214. The bracket plate 211 includes a plate portion 215 situated substantially in parallel to an imaginary plane which encompasses the x and z axes, and a plate portion 216 situated substantially in parallel to an imaginary plane which encompasses the y and z axes to form an L-shaped horizontal cross section. The reinforcing plate 212 is fixed to the upper edge surfaces of the plate portions 215, 216. The reinforcing plate 213 is fixed to the lower edge surfaces of the plate portions 215, 216. The reinforcing plates 212, 213 increase rigidity of the bracket plate 211. The plate portion 215 has a front surface 217 and a rear surface 218 opposite to the front surface 217. The guide slider 271 and the linear guide 214 are fixed to the rear surface 218. The plate portion 216 is bent from the left edge of the plate portion 215. The bracket plate 111 described with reference to FIG. 9 is fixed to the plate portion 216.

The bracket member 220 includes a bracket plate 221 and a reinforcing plate 222. The bracket plate 221 includes a plate portion 225 situated substantially in parallel to the imaginary plane which encompasses the x and z axes, and a plate portion 226 situated substantially in parallel to the imaginary plane which encompasses the y and z axes. The reinforcing plate 222 is fixed to the lower edge surfaces of the plate portions 225, 226 to reinforce the bracket plate 221. The plate portion 225 is connected to the guide slider 271 and the linear guide 214. When the air is supplied to the guide slider 271, the guide slider 271 pushes out the bracket plate 221 rightward. Accordingly, the bracket member 220 may move in the extending direction of the x axis relative to the bracket member 210. The linear guide 214 guides the displacement of the bracket plate 221 in the direction along the x axis. The guide slider 272 is mounted on the plate portion 226.

Figure 12:
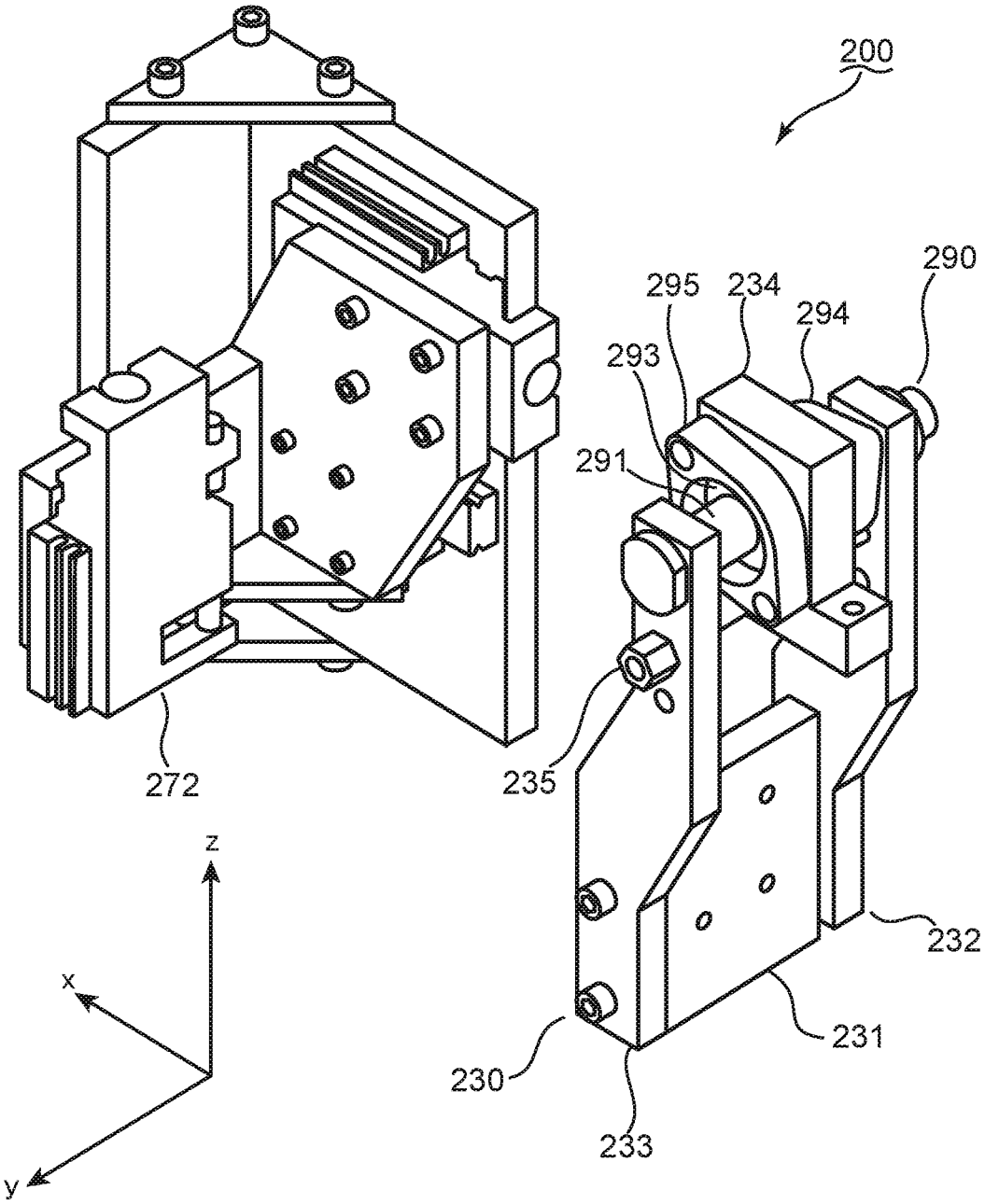
FIG. 12 is an exploded perspective view of a part of the gun bracket of the applicator shown in FIG. 4.

FIG. 12 is an exploded perspective view of a part of the gun bracket 200. The gun bracket 200 is further described with reference to FIG. 12.

The bracket member 230 includes a mounting plate 231, a front arm plate 232, a rear arm plate 233, an intermediate plate 234 and a connecting shaft 235. The mounting plate 231 is a rectangular plate member which is situated substantially in parallel to the imaginary plane which encompasses the y and z axes. The mounting plate 231 is fixed to the guide slider 272. When the air is supplied to the guide slider 272, the guide slider 272 pushes out the bracket member 230 upward. In short, the bracket member 230 may move in the extending direction of the z axis relative to the bracket member 220. The front arm plate 232 is fixed to the front edge surface of the mounting plate 231, and extends upward from the upper edge surface of the mounting plate 231. The rear arm plate 233 is fixed to the rear edge surface of the mounting plate 231, and extends upward from the upper edge surface of the mounting plate 231. The intermediate plate 234 is positioned between the front and rear arm plates 232, 233 above the mounting plate 231.

Figure 13:
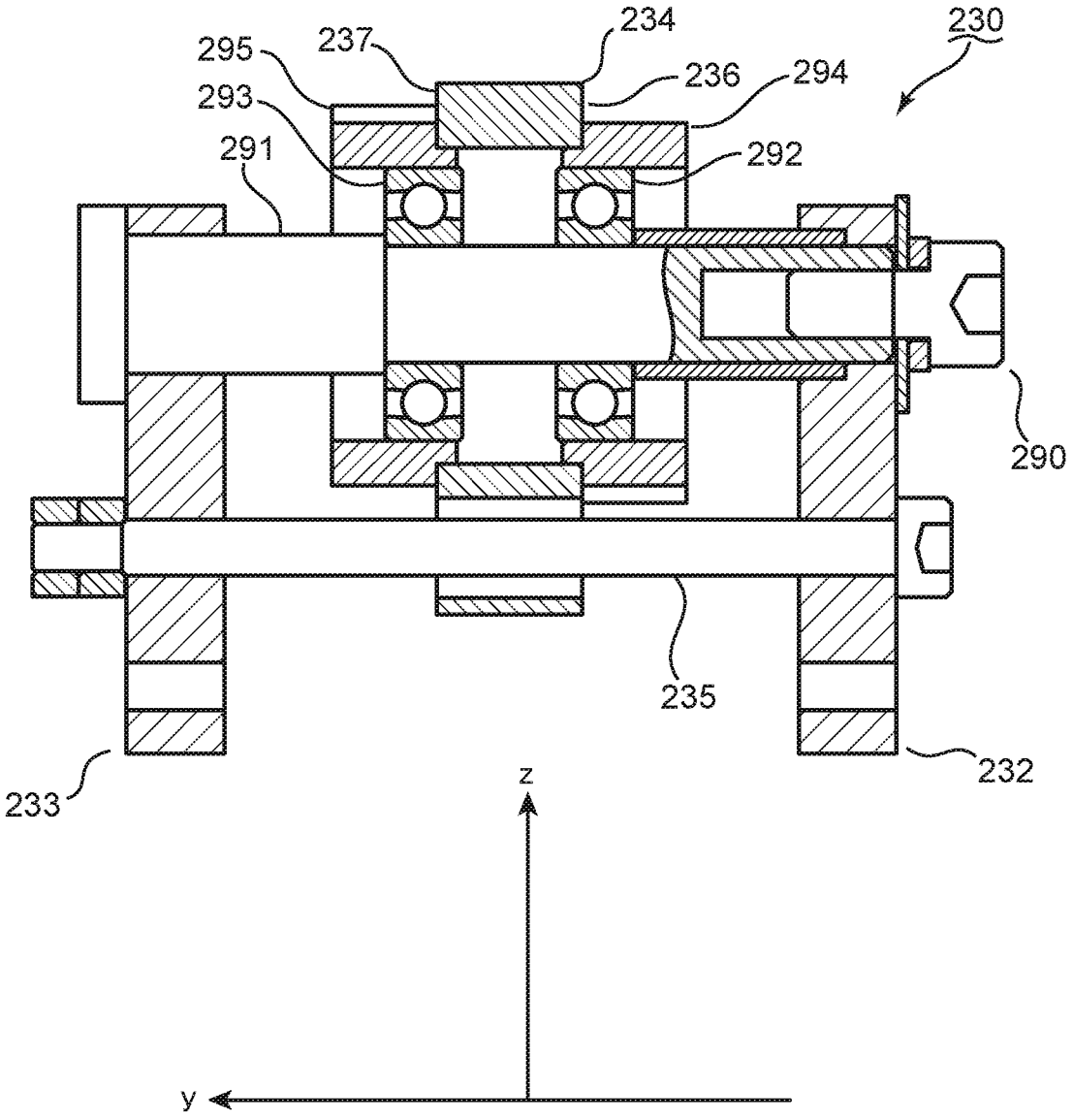
FIG. 13 is a schematic longitudinal cross-sectional view showing a part of a bracket member of the gun bracket shown FIG. 12.

FIG. 13 is a schematic longitudinal cross-sectional view of a part of the bracket member 230. The gun bracket 200 is further described with reference to FIGS. 12 and 13.

As shown in FIGS. 12 and 13, the connecting shaft 235 extends substantially in parallel to the y axis above the mounting plate 231, and extends through the front arm plate 232, the intermediate plate 234 and the rear arm plate 233. The intermediate plate 234 has a front surface 236 and a rear surface 237 opposite to the front surface 236. The front surface 236 faces the front arm plate 232. The rear surface 237 faces the rear arm plate 233.

The swing shaft portion 290 includes a shaft portion 291, two bearings 292, 293 and two bearing holders 294, 295. As shown in FIG. 13, the shaft portion 291 extends substantially in parallel to the y axis above the connecting shaft 235, and extends through the front arm plate 232, the intermediate plate 234 and the rear arm plate 233. Accordingly, the bracket member 230 may hold the swing shaft portion 290. The bearing holder 294 is fixed to the front surface 236 of the intermediate plate 234. A part of the bearing holder 294 is fitted in a circular opening which is formed in the intermediate plate 234 about the shaft portion 291. The remaining part of the bearing holder 294 protrudes from the front surface 236 of the intermediate plate 234 toward the front arm plate 232. The bearing 292 is fitted in an annular gap formed between the shaft portion 291 and the bearing holder 294. The bearing holder 295 is fixed to the rear surface 237 of the intermediate plate 234. A part of the bearing holder 295 is fitted in a circular opening which is formed in the intermediate plate 234 about the shaft portion 291. The remaining part of the bearing holder 295 protrudes from the rear surface 237 of the intermediate plate 234 toward the rear arm plate 233. The bearing 293 is fitted in an annular gap formed between the shaft portion 291 and the bearing holder 295.

The rotational axes of the bearings 292, 293 are substantially coincident to the center axis of the shaft portion 291. A through hole which is formed in the intermediate plate 234 to allow the penetration of the connecting shaft 235 has a diameter larger than an outer diameter of the connecting shaft 235. The intermediate plate 234 may be angularly displaced around the shaft portion 291 by an amount in correspondence to the difference between the diameter of the through hole and the outer diameter of the connecting shaft 235.

Figure 14:
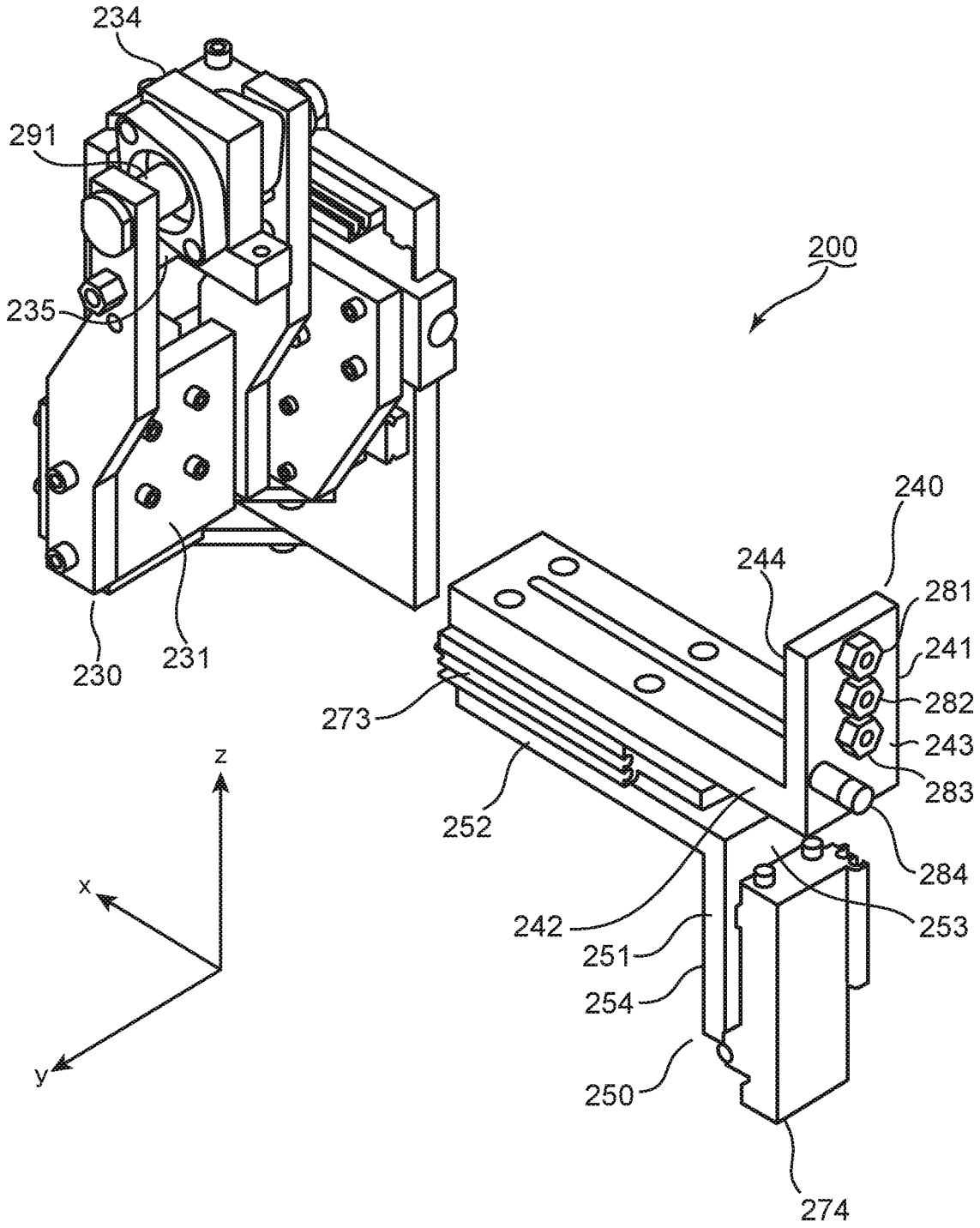
FIG. 14 is an exploded perspective view of a part of the gun bracket of the applicator shown in FIG. 4.

FIG. 14 is an exploded perspective view of a part of the gun bracket 200. The gun bracket 200 is further described with reference to FIGS. 9 and 14.

The bracket member 240 includes a plate portion 241 situated substantially in parallel to the imaginary plane which encompasses the y and z axes, and a plate portion 242 situated substantially in parallel to the imaginary plane which encompasses the x and y axes. The plate portion 242 is bent leftward from the lower end of the plate portion 241.

The plate portion 241 has a right surface 243, and a left surface 244 opposite to the right surface 243. The three ball rollers 281, 282, 283 and the guide roller 284 are fixed to the right surface 243. The three ball rollers 281, 282, 283 are aligned in the vertical direction (i.e. in the extending direction of the z axis) on the right surface 243. The ball roller 281 is situated at the uppermost position among the three ball rollers 281, 282, 283. The ball roller 283 is situated at the lowermost position among the three ball rollers 281, 282, 283. The ball roller 282 is situated between the ball rollers 281, 283. The guide roller 284 is positioned behind the row of the ball rollers 281, 282, 283 and below the ball roller 283.

The bracket member 250 includes a plate portion 251 situated substantially in parallel to the imaginary plane which encompasses the y and z axes, and a plate portion 252 situated substantially in parallel to the imaginary plane which encompasses the x and y axes. The plate portion 252 is bent leftward from the upper end of the plate portion 251. The plate portion 251 of the bracket member 250 is connected to the mounting plate 231 of the bracket member 230.

The plate portion 252 of the bracket member 250 is situated below the plate portion 242 of the bracket member 240. The guide slider 273 is situated between the plate portions 242, 252. The guide slider 273 is connected to the plate portions 242, 252 of the bracket members 240, 250. When the air is supplied to the guide slider 273, the guide slider 273 moves the plate portion 252 leftward.

The plate portions 242, 252 of the bracket members 240, 250 and the guide slider 273 are inserted into a space formed between the connecting shaft 235 and the upper edge of the mounting plate 231. The plate portion 242 of the bracket member 240 is connected to the intermediate plate 234. Accordingly, the bracket members 240, 250 and the guide slider 273 may be angularly displaced around the shaft portion 291 together with the intermediate plate 234.

The plate portion 252 of the bracket member 250 has a right surface 253, and a left surface 254 opposite to the right surface 253. The left surface 254 faces the mounting plate 231. The guide slider 274 is mounted on the right surface 253.

As shown in FIG. 9, the bracket member 260 is mounted on the guide slider 274. Accordingly, the guide slider 274 is situated between the bracket members 250, 260.

The bracket member 260 includes a plate portion 261 situated substantially in parallel to the imaginary plane which encompasses the y and z axes, and a plate portion 262 situated substantially in parallel to the imaginary plane which encompasses the x and z axes. The plate portion 261 is mounted on the guide slider 274. The plate portion 262 extends rightward from the plate portion 261. The coating gun 120 is fixed to the plate portion 262.

The coating gun 120 includes a vessel 310 and a nozzle head 320. The vessel 310 is fixed to the plate portion 262 of the bracket member 260. The nozzle head 320 is a cylindrical member which extends upward from the vessel 310. A mechanism for discharging the sealing agent from a discharge port (not shown) formed in the nozzle head 320 is stored mainly in the vessel 310. Mechanisms of known discharge devices for discharging liquid may be applied to the coating gun 120. Accordingly, the principles of the present embodiment are not limited to a particular device used as the coating gun 120. With regard to the present embodiment, the nozzle is exemplified by the nozzle head 320.

Figure 15:
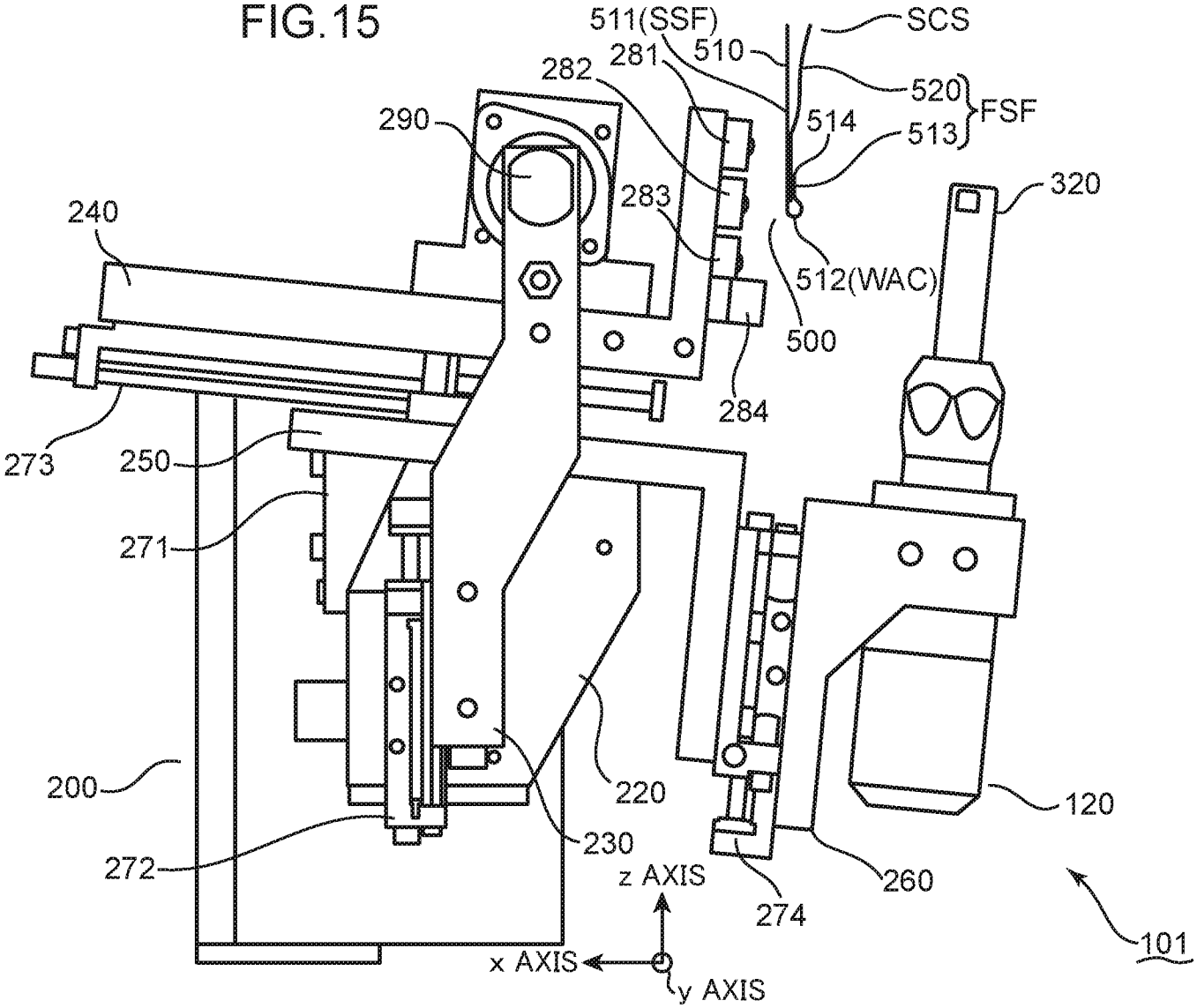
FIG. 15 is a schematic side view of the applicator shown in FIG. 4.

FIG. 15 is a schematic side view of the applicator 101. The applicator 101 is further described with the reference to FIGS. 1 and 15.

When the coating step is started, the read-out portion 641 of the first signal generator 631 reads out the second correction data from the storage 610. The second correction data is converted by the data converter 643 as described above. The converted second correction data is outputted from the data converter 643 to the drive signal generator 644. The drive signal generator 644 generates a drive signal with reference to information associated with "data point 1". The drive signal is outputted from the drive signal generator 644 to the drive portion 410. The drive portion 410 drives the holding portion 420 and the applicator 101 in response to the drive signal. Accordingly, the coordinate origin is set at the position associated with the data point 1 (i.e. the position indicated by a coordinate (X1, Y1+HGP, Z+VGP)). In addition, the posture of the applicator 101 is set to the coating posture. FIG. 15 shows the applicator 101 after these processes are completed.

FIGS. 16A to 16F are schematic side views of the applicator 101. Operations of the applicator 101 are described with reference to FIGS. 1 to 16F.

As described above, when the coating step is started, the read-out portion 641 of the first signal generator 631 reads out the second correction data from the storage 610. The read-out portion 641 notifies the trigger signal generator 642 of the completion of reading out the second correction data. The trigger signal generator 642 generates a trigger signal in response to the notification from the read-out portion 641. The trigger signal is outputted from the trigger signal generator 642 to the switching signal generator 634. The switching signal generator 634 executes a predetermined program (referred to as "initial setting program" in the following description) which causes operations of determining the posture of the applicator 101 shown in FIGS. 15 to 16F in response to the trigger signal. Not only the switching signal generator 634 but also the first signal generator 631 is operated in accordance with the initial setting program.

First, the air supply source 430 supplies the air to the guide sliders 271, 272 (c.f. FIG. 1). Accordingly, the guide slider 271 pushes out the bracket member 220 rightward with a given force whereas the guide slider 272 pushes out the bracket member 230 upward with a given force. The guide sliders 272, 273, 274, the bracket members 230, 240, 250, 260, the ball rollers 281, 282, 283, the guide roller 284 and the coating gun 120 are mounted on the bracket member 220, so that these constitutional members are pushed out rightward together with the bracket member 220. The guide sliders 273, 274, the bracket members 240, 250, 260, the ball rollers 281, 282, 283, the guide roller 284 and the coating gun 120 are mounted on the bracket member 230, so that these constitutional members are pushed out upward together with the bracket member 230.

Figure 16A:
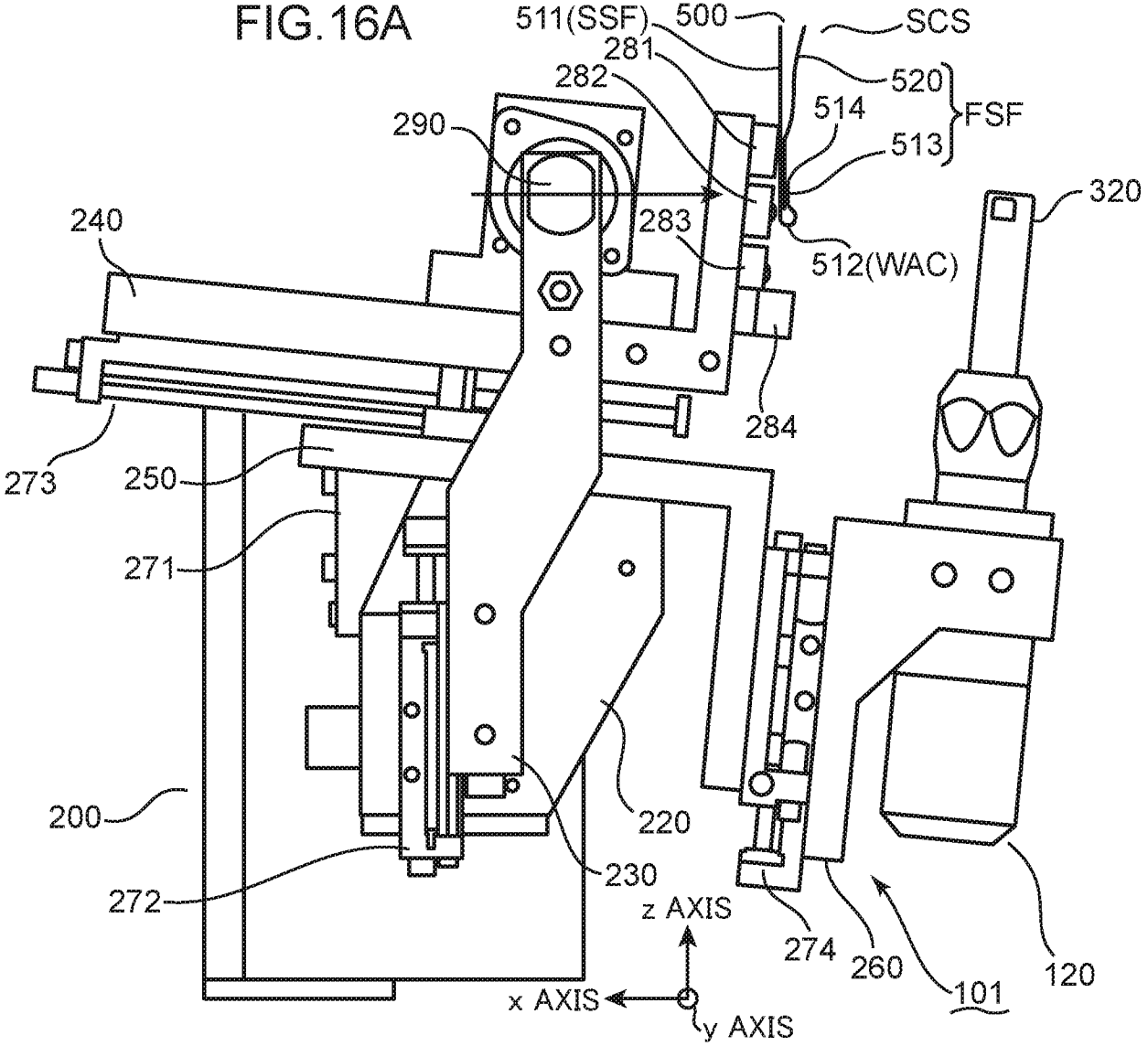
FIG. 16A is a schematic side view of the applicator shown in FIG. 4.

Then, the drive signal generator 644 generates a drive signal in accordance with the initial setting program. The drive signal is outputted from the drive signal generator 644 to the drive portion 410. As shown in FIG. 16A, the drive portion 410 moves the gun bracket 200 rightward in response to the drive signal. Accordingly, the ball roller 281 is brought into contact with the main plate portion 511.

Figure 16B:
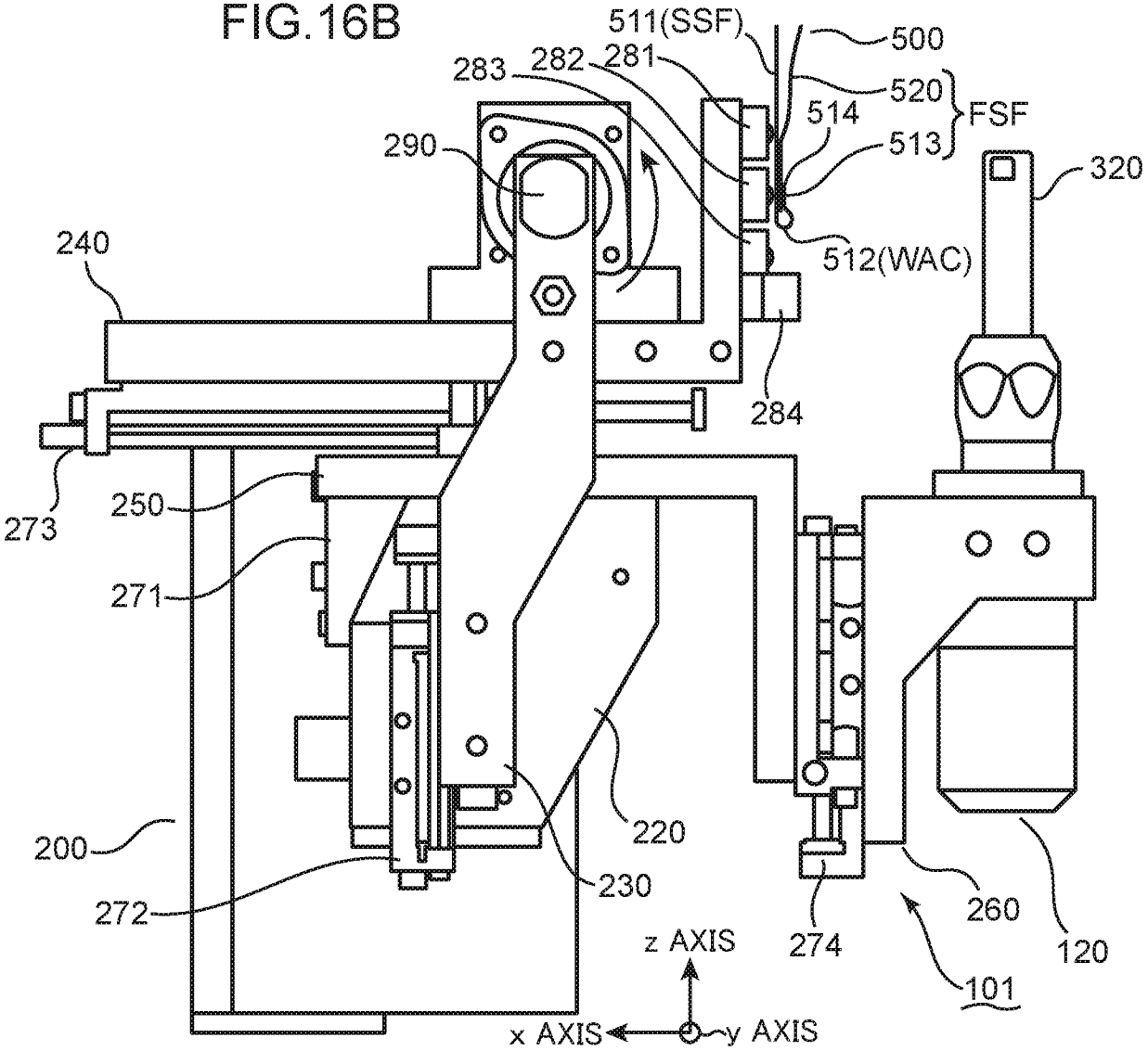
FIG. 16B is a schematic side view of the applicator shown in FIG. 4.

As shown in FIG. 16B, when the drive portion 410 further moves the gun bracket 200 rightward, the bracket member 240 is angularly displaced around the swing shaft portion 290 (i.e. the y axis). Accordingly, not only the ball roller 281 but also the ball roller 282 is brought into contact with the main plate portion 511.

Figure 16C:
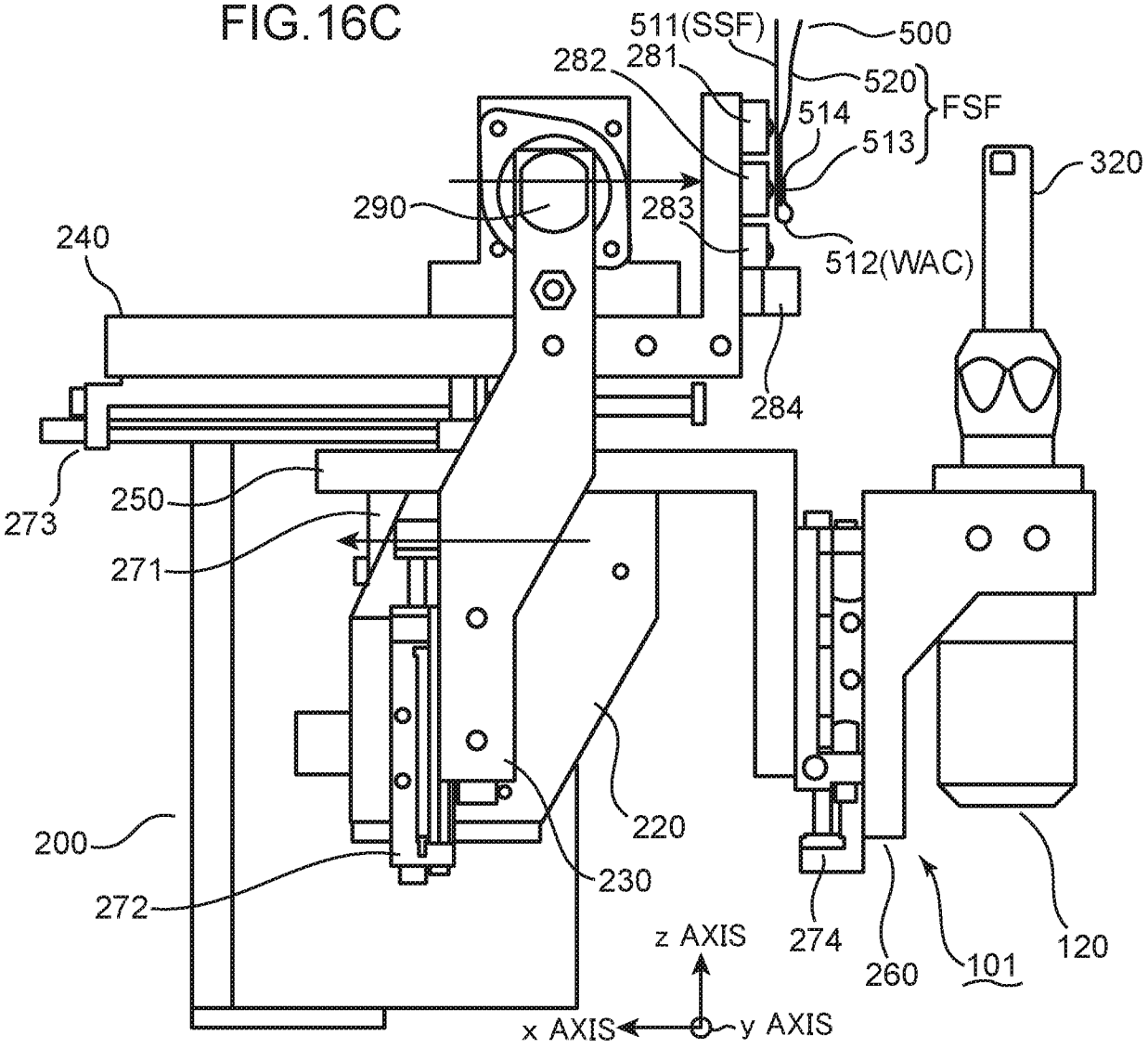
FIG. 16C is a schematic side view of the applicator shown in FIG. 4.

As shown in FIG. 16C, the drive portion 410 further moves the gun bracket 200 rightward. As described above, the air is supplied to the guide slider 271, so that the guide slider 271 functions as a cushion. Accordingly, the robot 400 (c.f. FIG. 1) may strongly bring the ball rollers 281, 282 into pressure contact with the main plate portion 511 without damaging the main plate portion 511. While the drive portion 410 moves the gun bracket 200 along the wheel arch WAC, at least one of the ball rollers 281, 282, 283 is continuously brought into pressure contact with the main plate portion 511 due to a cushion action of the guide slider 271. In short, the gun bracket 200 may be finely displaced in the extending direction of the x axis in accordance with a surface shape of the main plate portion 511 (i.e. a concavo-convex shape of the second surface SSF).

Figure 16D:
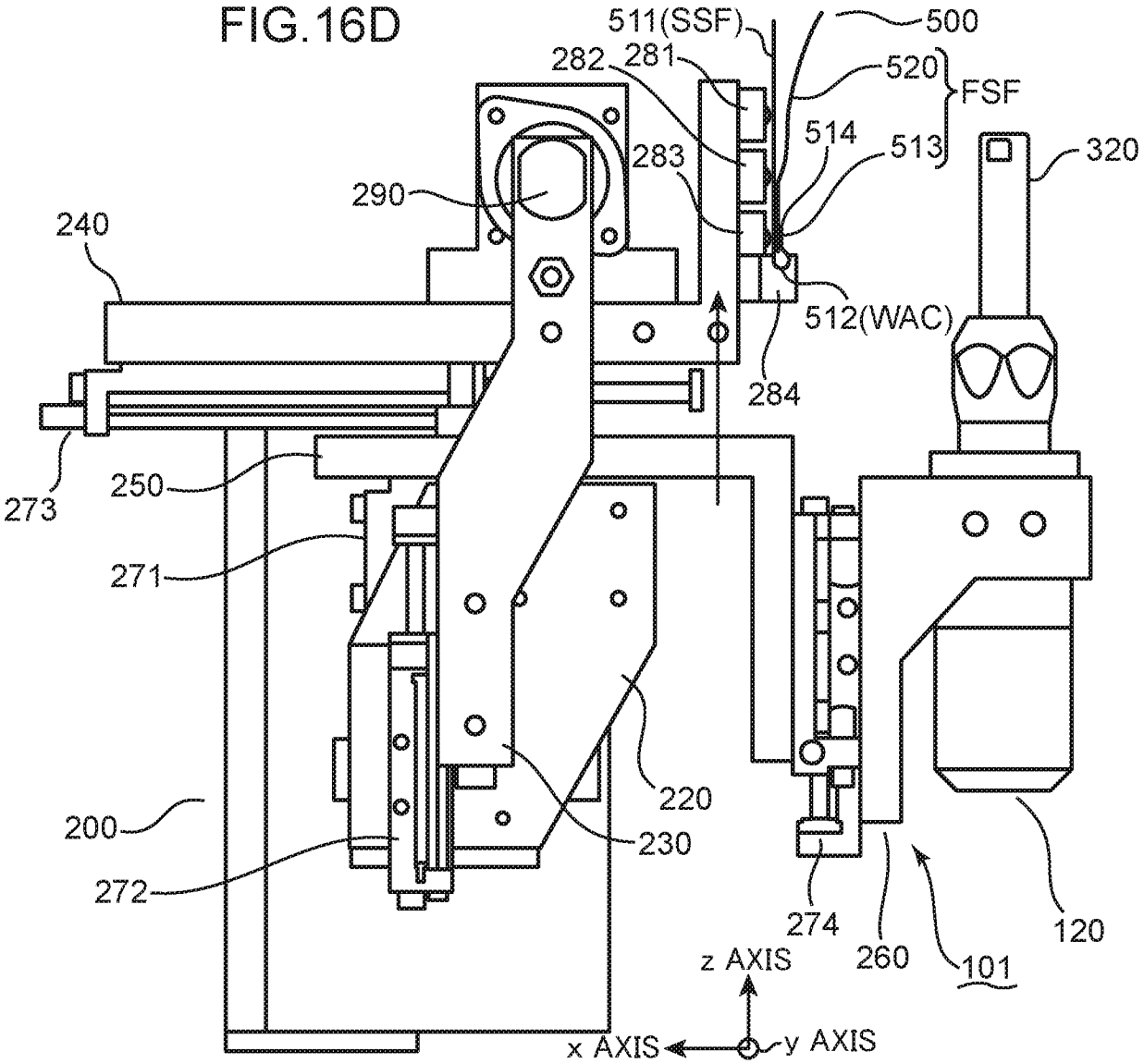
FIG. 16D is a schematic side view of the applicator shown in FIG. 4.

After the ball rollers 281, 282 are strongly brought into pressure contact with the main plate portion 511, the drive portion 410 moves the gun bracket 200 upward. Accordingly, the circumferential surface of the guide roller 284 which is fixed to the bracket member 240 is brought into contact with the bent edge 512 (c.f. FIG. 16D). While the gun bracket 200 moves upward, the balls of the ball rollers 281, 282, 283 roll on the surface of the main plate portion 511. When the guide roller 284 is brought into contact with the bent edge 512, the ball rollers 281, 282, 283 are brought into point contact with the surface of the main plate portion 511.

Figure 16E:
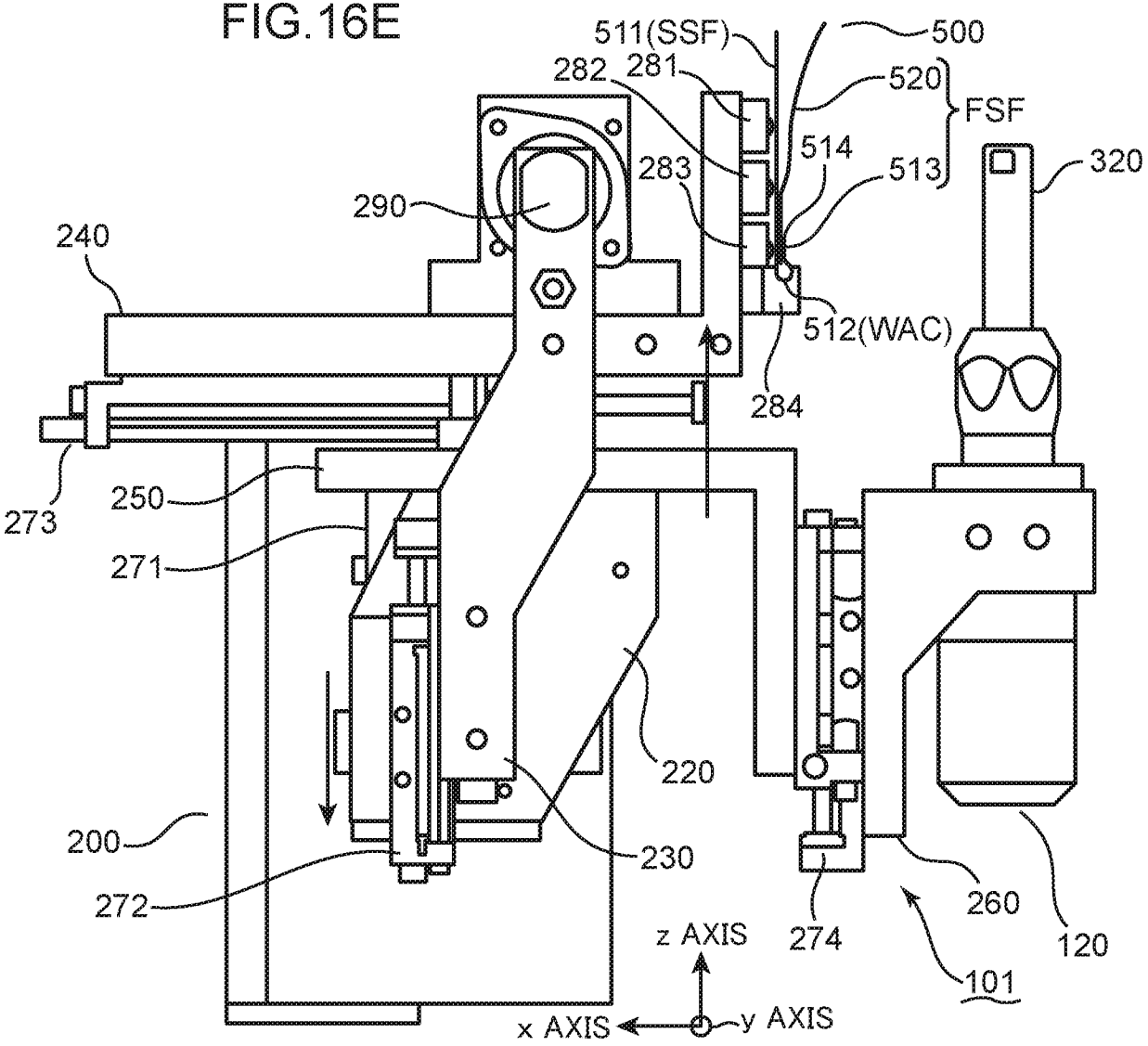
FIG. 16E is a schematic side view of the applicator shown in FIG. 4.

As shown in FIG. 16E, the drive portion 410 further moves the gun bracket 200 upward. As described above, the air is supplied to the guide slider 272, so that the guide slider 272 functions as a cushion. Accordingly, the robot 400 (c.f. FIG. 1) may strongly bring the guide roller 284 into pressure contact with the bent edge 512 without damaging the bent edge 512. While the drive portion 410 moves the gun bracket 200 along the wheel arch WAC, the guide roller 284 rotates about a rotational axis in parallel to the x axis with being continuously brought into pressure contact with the bent edge 512 due to a cushion action of the guide slider 272. In short, the gun bracket 200 may be finely displaced in accordance with the shape of the bent edge 512.

Figure 16F:
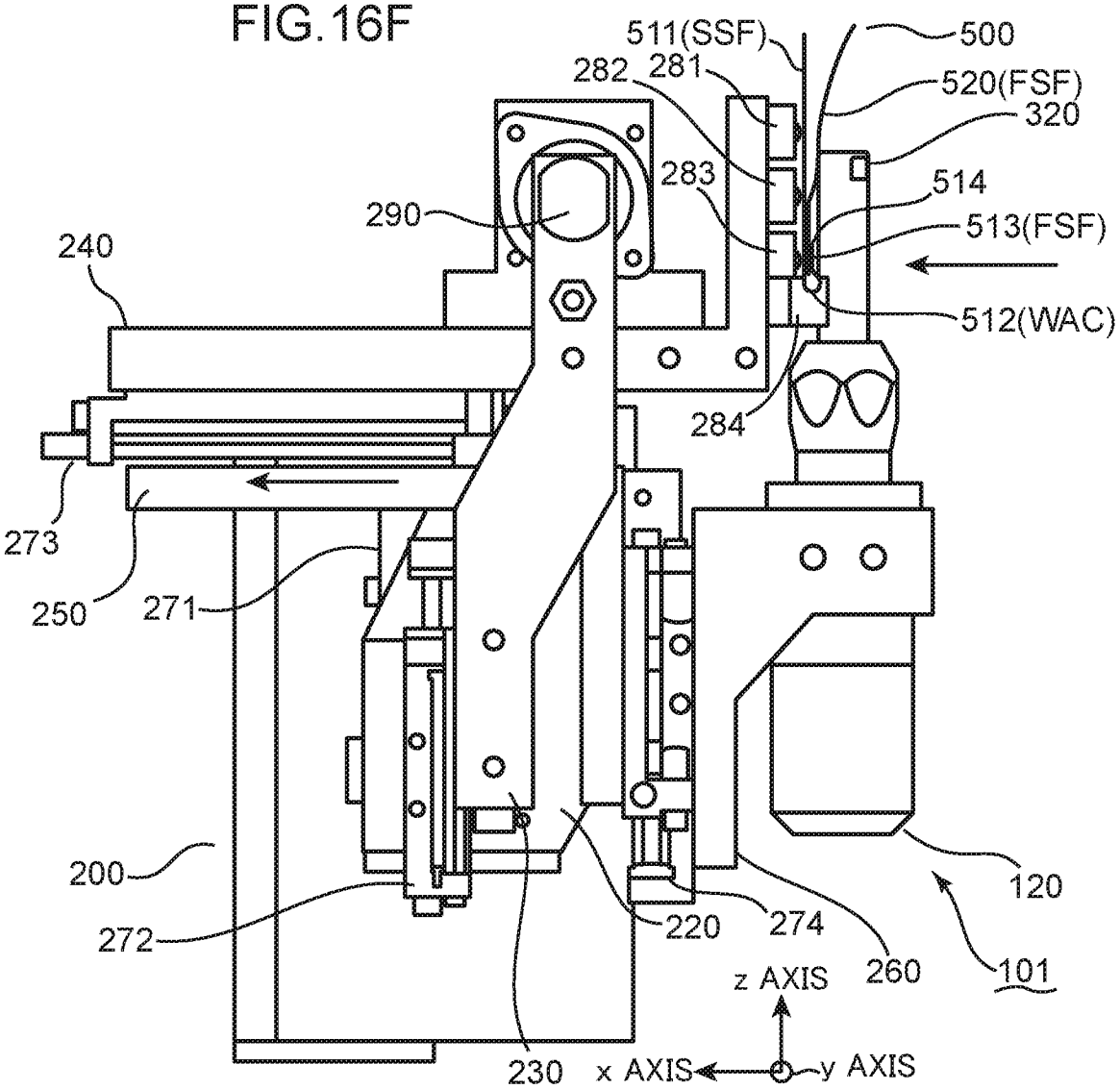
FIG. 16F is a schematic side view of the applicator shown in FIG. 4.

After the drive portion 410 moves the gun bracket 200 upward, the switching signal generator 634 opens the switching valve 443 in accordance with the initial setting program (c.f. FIG. 1). The air is supplied to the guide slider 273, so that the guide slider 273 moves the bracket member 250 connected to the guide slider 273 leftward (c.f. FIG. 16F). The coating gun 120 is connected to the bracket member 250 by the guide slider 274 and the bracket member 260, so that the nozzle head 320 may move leftward together with the bracket member 250. As a result of the leftward movement of the bracket members 250, 260 and the guide slider 274 relative to the bracket member 240, the nozzle head 320 may approach the hem strip 513.

While the robot 400 moves the gun bracket 200 along the wheel arch WAC, the guide slider 271 brings the ball rollers 281, 282, 283 into pressure contact with the main plate portion 511, so that the nozzle head 320 may be finely displaced in the extending direction of the x axis in accordance with the surface shape of the main plate portion 511. Accordingly, both the guide sliders 271, 273 play a role of allowing the displacement of the coating gun 120 in the extending direction of the x axis.

As described above, while the initial setting program is executed, the drive signal generator 644 generates drive signals for moving the applicator 101 rightward and upward. In this case, the drive signal generator 644 stores a rightward movement amount and an upward movement amount of the applicator 101. The rightward movement amount is added to X coordinate values of the second correction data which the drive signal generator 644 receives from the data converter 643. The upward movement amount is added to Y coordinate values. The drive signal generator 644 generates drive signals during the succeeding coating step by taking into account a movement amount of the applicator 101 which is generated while the initial setting program is executed.

Figure 17:
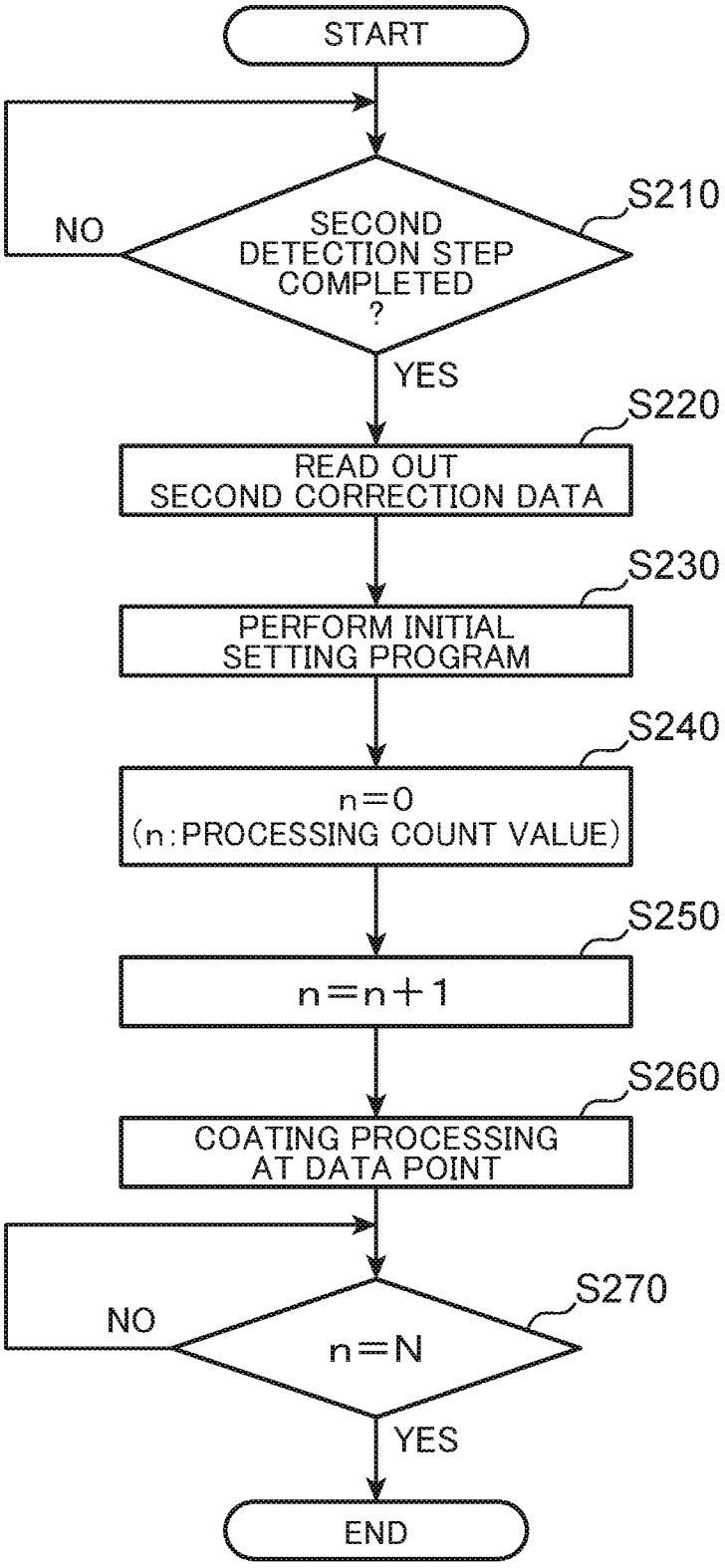
FIG. 17 is a schematic flowchart showing an operation of a coating step of the controller of the coating device shown in FIG. 1 during the coating step.

FIG. 17 is a schematic flowchart showing operations during the coating step of the controller 600. The operations of the controller 600 during the coating step are described with reference to FIGS. 1, 2, 8 to 17.

(Step S210)

The controller 600 waits for the completion of the first detection step. When the first detection step is completed, step S220 is performed.

(Step S220)

The read-out portion 641 of the first signal generator 631 reads out the second correction data from the storage 610. The second correction data is outputted from the read-out portion 641 to the data converter 643. The data converter 643 generates the second correction data (c.f. Table 4) for the coating step by adding "90°" to the rotational angle θ of the second correction data. The second correction data for the coating step is outputted to the drive signal generator 644 and the coating amount notification portion 645. The drive signal generator 644 refers the data point 1 of the second correction data to move the applicator 101 to the coating start position, and sets the rotational angle θ of the applicator 101 to the angle "θ1" in correspondence to the data point 1. Accordingly, the nozzle head 320 faces the hem strip 513.

The read-out portion 641 notifies the trigger signal generator 642 of the completion of reading out the second correction data. The trigger signal generator 642 generates a trigger signal in response to the notification of the completion of reading out the second correction data. The trigger signal is outputted from the trigger signal generator 642 to the switching signal generator 634. After the trigger signal is outputted, step S230 is performed.

(Step S230)

The first signal generator 631 and the switching signal generator 634 perform the initial setting program to allow the applicator 101 to perform the operations described with reference to FIGS. 15 to 16F. After the initial setting program is executed, step S240 is performed.

(Step S240)

The drive signal generator 644 and the coating amount notification portion 645 of the first signal generator 631 synchronously initialize a processing count value n used for indicating a data point in the second correction data. Then, step S250 is performed.

(Step S250)

The drive signal generator 644 and the coating amount notification portion 645 synchronously add "1" to the processing count value n. Then, step S260 is performed.

(Step S260)

The drive signal generator 644 and the coating amount notification portion 645 synchronously perform processes for the data point n. For example, when the processing count value n is equal to the natural number "M", the drive signal generator 644 refers the fixed coordinate value (XM, YM, ZM) in correspondence to the data point M to generate a drive signal by taking into account an amount of movement of the applicator 101 which is generated while the initial setting program is executed. The drive signal is outputted from the drive signal generator 644 to the drive portion 410. The drive portion 410 drives the holding portion 420. Accordingly, the applicator 101 may move to the position designated by the drive signal. In addition, the drive signal generator 644 refers the rotational angle θ in correspondence to the data point M to set the rotational angle of the applicator 101 to "θM+90°". The coating amount notification portion 645 refers the coating amount associated with the data point M, and notifies the second signal generator 632 of coating amount information indicating the coating amount AM. The second signal generator 632 generates a gun control signal in correspondence to the coating amount information. The gun control signal is outputted from the second signal generator 632 to the coating gun 120. The coating gun 120 discharges an amount of the sealing agent in correspondence to the gun control signal. In short, the coating gun 120 may discharge the coating amount AM of the sealing agent. When the aforementioned process at the data point n is completed, step S270 is performed.

(Step S270)

The drive signal generator 644 and the coating amount notification portion 645 determine whether or not the processing count value n is equal to the natural number "N" indicating the coating end position. When the processing count value n is equal to the natural number "N", the coating step is completed. Otherwise, step S250 is performed.

While the processing routine from steps S250 to S270 is repeated, the nozzle head 320 faces the hem edge 514, and the bracket 110 which holds the coating gun 120 moves in accordance with the second correction data shown in Table 4. As described above, since the second correction data is generated so that the applicator 101 moves along the wheel arch WAC, the sealing agent may be accurately applied to the hem edge 514 from the nozzle head 320.

While the sealing agent is discharged from the nozzle head 320, the ball rollers 281, 282, 283 are brought into contact with the main plate portion 511 whereas the guide roller 284 is brought into contact with the wheel arch WAC. Accordingly, even when the shape of the hem portion 500 is deviated from the shape of the hem portion 500 which is determined in design (e.g. a concavo-convex shape of the surface of the main plate portion 511 or a waviness of a profile of the wheel arch WAC), the applicator 101 may follow the actual shape of the hem portion 500.

(Second Detection Step)

When the second detection step is started, the applicator 101 is returned to the detection posture from the coating posture. Then, the read-out portion 641 reads out the second correction data from the storage 610. The second correction data is outputted from the read-out portion 641 to the data converter 643. Like the first detection step, the data converter 643 directly outputs the second correction data to the drive signal generator 644.

The drive signal generator 644 generates a drive signal with reference to the second correction data. The drive signal is outputted from the drive signal generator 644 to the drive portion 410. The drive portion 410 drives the holding portion 420 in response to the drive signal. Accordingly, the coordinate origin (i.e. the connection point between the holding portion 420 and the bracket plate 111) may be moved continuously in accordance with the fixed coordinate which is determined by the second correction data. During such movement of the coordinate origin, the detection area DTA continuously scans the first and second surfaces FSF, SSF from the coating start position to the coating end position. The drive portion 410 generates the movement data indicating a movement amount of the holding portion 420. The movement data is outputted from the drive portion 410 to the storage 610.

The read-out portion 641 notifies the trigger signal generator 642 of the completion of reading out the second correction data from the storage 610. The trigger signal generator 642 generates a trigger signal in response to the notification from the read-out portion 641. The trigger signal is outputted from the trigger signal generator 642 to the sensor controller 135. The sensor controller 135 outputs a detection result acquired from the first and second sensors 131, 132 in response to the trigger signal. The detection result is outputted from the sensor controller 135 to the storage 610 in response to the trigger signal, so that the storage 610 may receive the detection result in synchronism with the aforementioned movement data. Accordingly, the storage 610 may store the detection result in association with the movement data. With regard to the present embodiment, the second detection data is exemplified by the detection result which is outputted from the sensor controller 135 to the storage 610 in the second detection step.

(Data Processing Step)

Figure 18A:
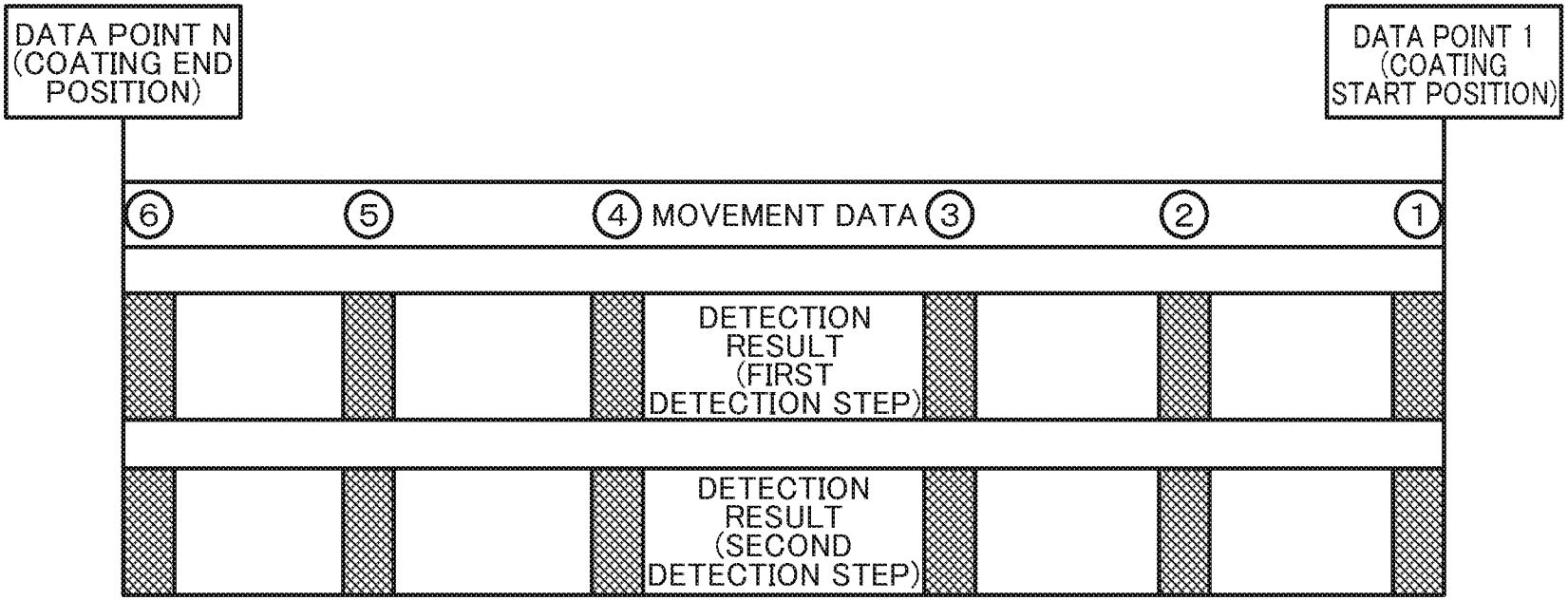
FIG. 18A is a conceptual view of a detection result stored in a storage of the coating device shown in FIG. 1.
Figure 18B:
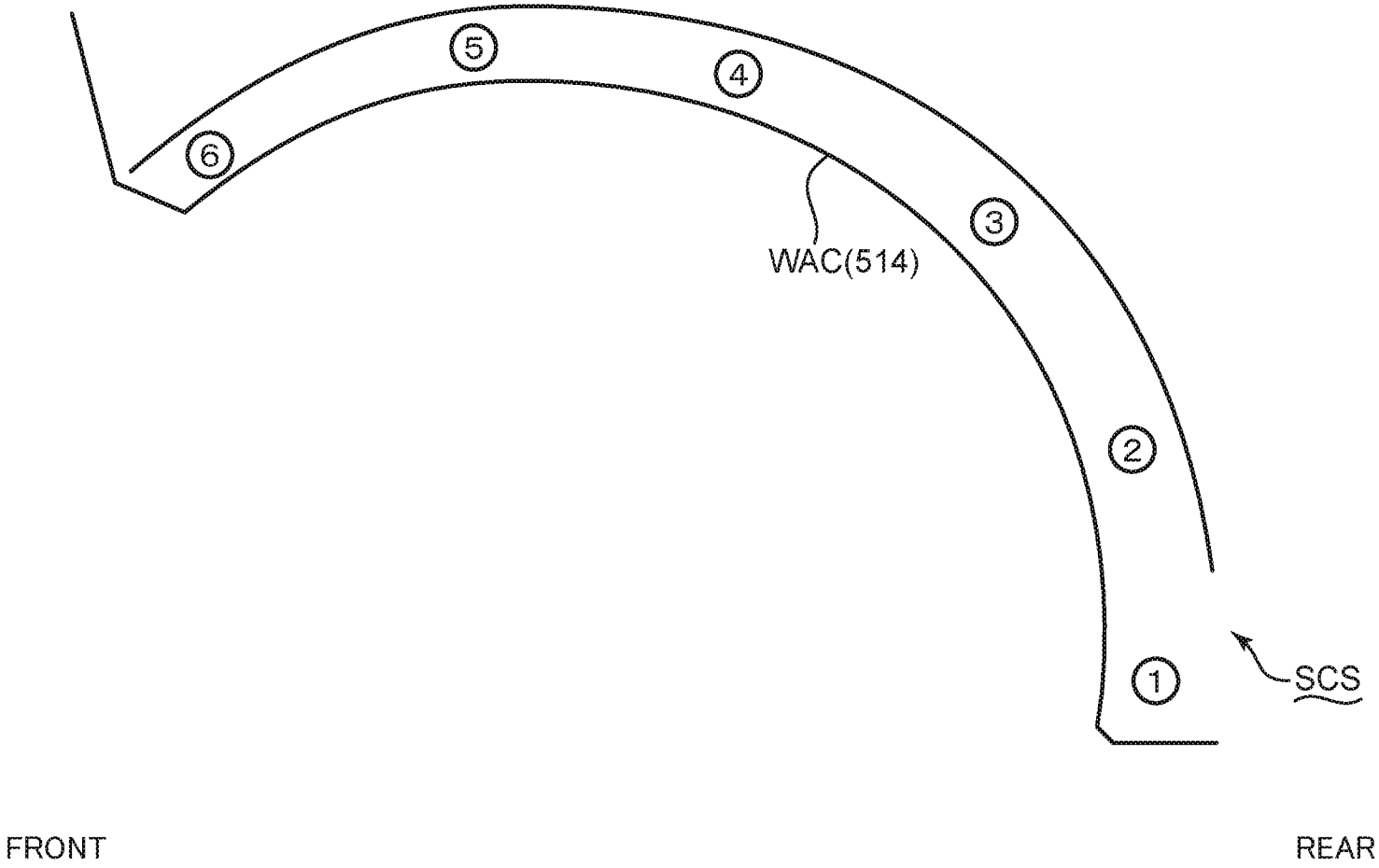
FIG. 18B is a schematic side view of the vehicle body.

FIG. 18A is a conceptual view of a detection result stored in the storage 610. FIG. 18B is a schematic side view of the vehicle body SCS. The data processing step is further described with reference to FIGS. 1, 18A and 188.

As described above, the detection results acquired by the first and second detection steps are stored in the storage 610 in a state in which the detection results are associated with the movement data. Accordingly, these detection results may be associated with positions on the vehicle body SCS around the wheel arch WAC. FIGS. 18A and 18B show numerals "1" to "6" surrounded by the circles. These numerals indicate inspection positions. These inspection positions are set intermittently in the coating zone. With regard to the present embodiment, the detection positions are exemplified by the inspection positions "1" to "6".

The extraction portion 622 refers the detection results stored in the storage 610, and reads out the detection results in correspondence to the respective inspection positions. In short, the extractor 622 extracts a detection result in correspondence to an inspection position from the whole detection results stored in the storage 610. The detection result extracted from the detection result which has been acquired by the first detection step is referred to as "first extraction data" in the following description. The detection result extracted from the detection result acquired by the second detection step is referred to as "second extraction data" in the following description. The first extraction data and the second extraction data are outputted from the extractor 622 to the comparison portion 623.

Figure 19:
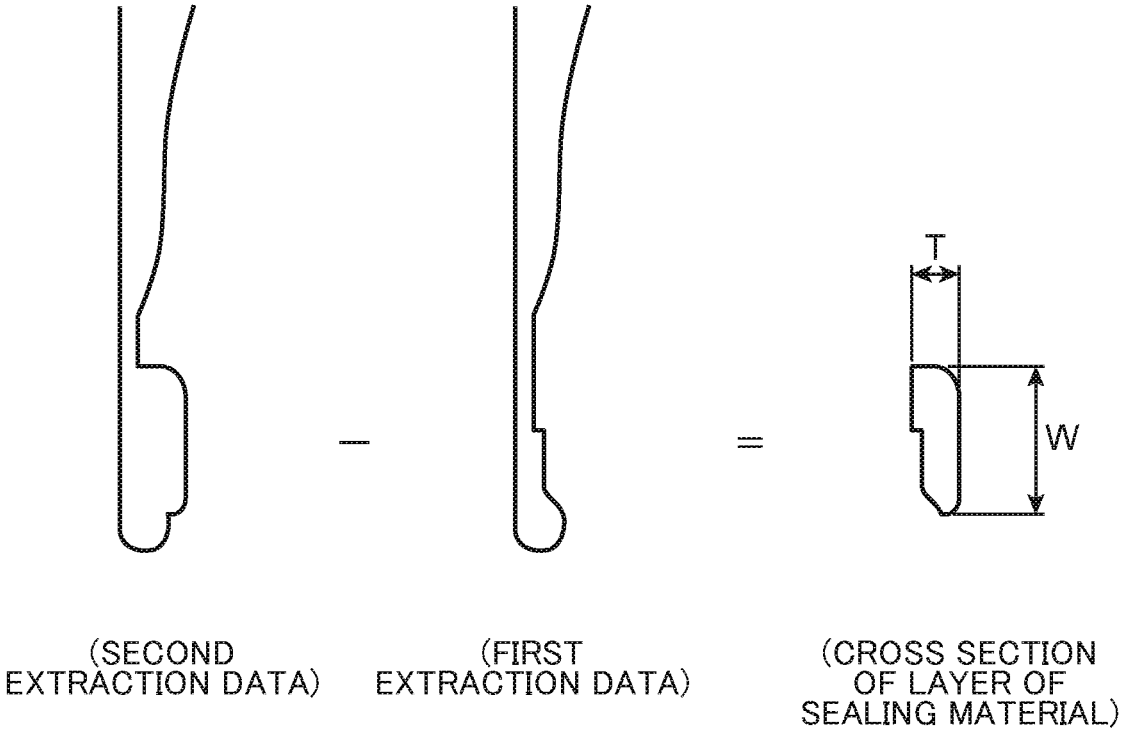
FIG. 19 is a conceptual view of a data process performed by a comparison portion of the coating device shown in FIG. 1.

FIG. 19 is a conceptual view of data process performed by the comparison portion 623. The data process of the comparison portion 623 is described with reference to FIGS. 1, 2 and 19.

FIG. 19 shows the first extraction data and the second extraction data in correspondence to one of the inspection positions "1" to "6". The first extraction data may indicate an outer shape of a cross section of the hem portion 500. The second extraction data may indicate an outer shape of a cross section where a layer of the sealing agent is overlapped to the hem portion 500.

The comparison portion 623 subtracts the first extraction data from the second extraction data. Accordingly, the cross-sectional shape of the layer of the sealing agent may be determined. The cross-sectional shape of the layer of the sealing agent may indicate a coating state of the sealing agent. Coating state data indicating the cross-sectional shape of the layer of the sealing agent is outputted from the comparison portion 623 to the determination portion 624.

The determination portion 624 may determine a thickness T and a width W of the layer of the sealing agent on the basis of the coating state data. When the thickness T and the width W are less than predetermined lower limit threshold values or larger than predetermined upper limit threshold values, the determination portion 624 determines that the sealing agent is applied inappropriately. When the thickness T and the width W fall in the ranges from the lower limit threshold values to the upper limit threshold values, the determination portion 624 determines that the sealing agent is appropriately applied.

(Additional Technical Features)

It may be determined in the first detection step whether or not the shape of the hem portion 500 is appropriate. When it is determined that the shape of the hem portion 500 is inappropriate, the coating step may be cancelled. Accordingly, it is possible to avoid unnecessary coating of the sealing agent.

Figure 20:
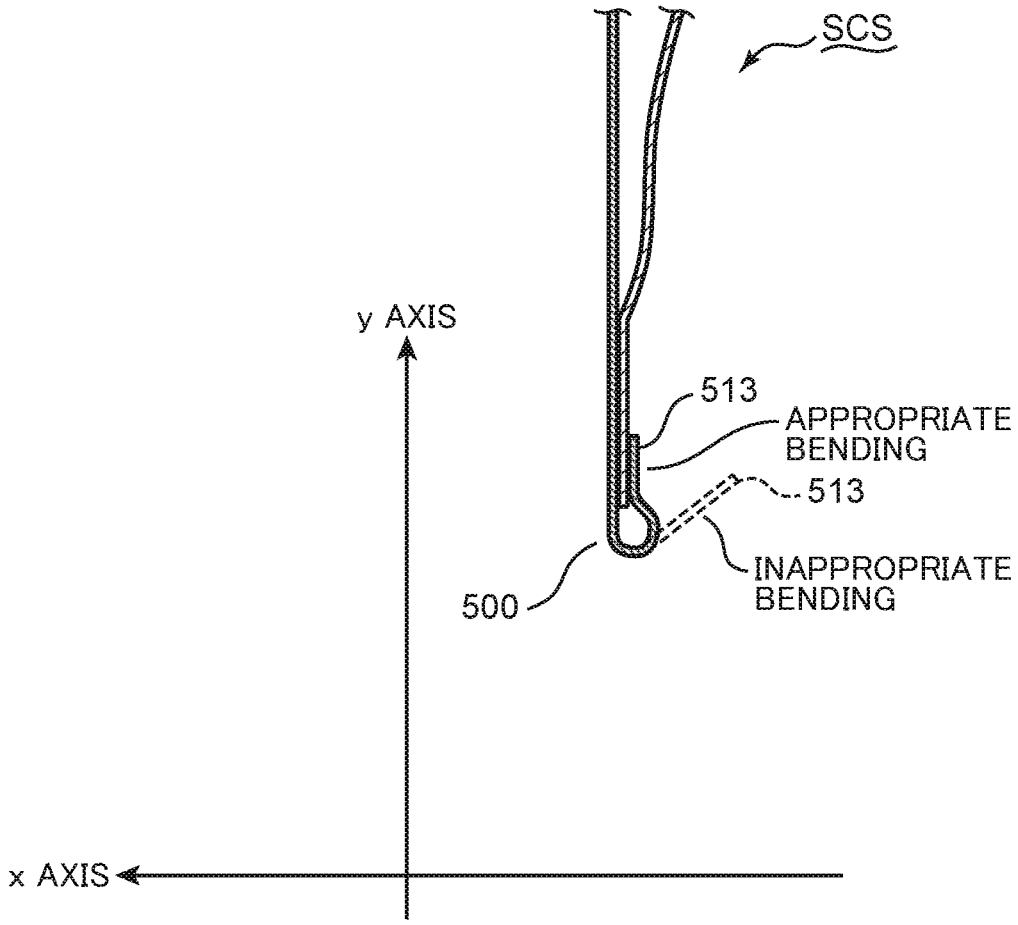
FIG. 20 is a schematic side view of the vehicle body.

FIG. 20 is a schematic side view of the vehicle body SCS. The shape inspection of the hem portion 500 in the first detection step is described with reference to FIG. 20.

The hem strip 513 which is indicated by the solid line in FIG. 20 is bent appropriately. On the other hand, bending of the hem strip 513 indicated by the dotted line in FIG. 20 is incomplete. When the hem strip 513 is bent appropriately, the thickness (i.e. the size in the extending direction of the x axis) of the hem portion 500 indicated by the detection result acquired in the first detection step is not excessively increased. When the bending of the hem strip 513 is incomplete, the thickness of the hem portion 500 indicated by the detection result acquired in the first detection step is excessively increased. Accordingly, the determination portion 624 may compare the thickness of the hem portion 500 with the predetermined threshold value by extracting a part of the detection result acquired from the first detection step (e.g. the detection results in correspondence to the inspection positions "1" to "6" shown in FIG. 18A) or by reading out the whole detection results acquired from the first detection step. When the thickness of the hem portion 500 exceeds the threshold value, the determination portion 624 may determine that a defect has occurred in the formation of the hem portion 500. When the thickness of the hem portion 500 is less than the threshold value, the determination portion 624 may determine to perform the coating step succeeding to the first detection step.

The quality determination of the shape of the hem portion 500 may be performed from other viewpoints. Accordingly, the principles of the present embodiment are not limited to particular criteria for determining the quality of the shape of the hem portion 500. For example, a distance from the bent edge 512 to the hem edge 514 may be compared with upper and/or lower limit threshold values.

The aforementioned various technical features may be combined with each other or may be altered to meet requests from various manufacturing sites.

The controller may be designed as a device separate from the robot. Alternatively, the controller may be designed integrally with the robot.

The exemplary techniques described in the context of the aforementioned various embodiments mainly include the following features.

A coating method according to one aspect of the aforementioned embodiments uses a nozzle for discharging a coating agent, a first sensor configured to detect a shape of a first surface of an object and a second sensor configured to detect a shape of a second surface of the object which is opposite to the first surface. The coating method includes: continuously moving a detection area formed by the first and second sensors which are held by a bracket so that the first sensor faces the first surface whereas the second sensor faces the second surface to make the object be situated between the first and second sensors, over a coating zone which extends from a predetermined start point position to a predetermined end point position to make the first and second sensors detect the shapes of the first and second surfaces before application of the coating agent to the object and generate first detection data; moving the bracket which holds the nozzle with bringing the bracket into contact with the object to apply the coating agent to the object over the coating zone; continuously moving the detection area over the coating zone to make the first and second sensors between which the object is situated detect the shapes of the first and second surfaces after the application to the coating agent to the object and generate second detection data; extracting first extraction data in correspondence to detection positions intermittently set in the coating zone from the first detection data, and second extraction data in correspondence to the detection positions from the second detection data; and comparing the first extraction data with the second extraction data to detect a coating state of the coating agent.

According to the aforementioned configuration, when the coating agent is applied to the object, the bracket which holds the nozzle for discharging the coating agent moves with being brought into contact with the object. Therefore, the nozzle may move in accordance with an actual shape of the object even under the presence of small differences between the shape of the object in design and the actual shape of the object. Accordingly, the coating agent may be applied to appropriate positions on the object even without accurately detecting shapes at a lot of points on the object. Consequently, the shape of the object may not be inspected continuously over the whole coating zone. In short, the shape inspection of the object may be performed at detection positions intermittently set in the coating zone. Accordingly, it is possible to reduce effort and time necessary for the shape inspection.

The first extraction data and the second extraction data in correspondence to the detection positions intermittently set in the coating zone are extracted from the first detection data and the second detection data respectively, so that the setting of the detection positions may be dependent on computer techniques. Mechanical and/or physical operations for setting the detection positions are unnecessary, so that effort and time necessary for the shape detection may be reduced.

The second extraction data indicates a shape resultant from overlapping a shape of the object before a coating agent is applied to the object with a shape of the coating agent on the object. Accordingly, the shape of the coating agent on the object (i.e. a coating state of the coating agent) may be obtained by comparing the first extraction data indicating the shape of the object before the coating agent is applied to the object with the second extraction data. Therefore, it is possible to determine whether or not the coating agent is appropriately applied to the object.

With regard to the aforementioned configuration, the object may be a hem portion including a main plate portion which forms the second surface, and a hem strip which is bent from the main plate portion along a bent edge to form a part of the first surface. The hem strip may include a hem edge extending in an extending direction of the bent edge at a position spaced apart from the bent edge. The moving the bracket to apply the coating agent may include applying a sealing agent as the coating agent to the hem edge.

According to the aforementioned configuration, the sealing agent is applied to the hem edge as the coating agent, so that it is less likely that liquid is intruded into a boundary between the main plate portion and the hem strip. Accordingly, the hem portion may be subjected to appropriate rust prevention treatment.

With regard to the aforementioned configuration, the continuously moving the detection area may include detecting a position of the hem edge. The moving the bracket to apply the coating agent may include adjusting a position of the nozzle in accordance with the position of the hem edge.

According to the aforementioned configuration, a position of the nozzle is adjusted in correspondence to a detected position of the hem edge, so that the sealing agent may be accurately applied to the hem edge.

With regard to the aforementioned configuration, each of the first and second sensors may be formed of a laser sensor. The continuously moving the detection area may include: (i) overlapping a laser beam in a planar shape, which is radiated from the first sensor, with a laser beam in planar shape, which is radiated from the second sensor, to form the detection area; and (ii) arranging the object across the detection area to optically detect the shapes of the first and second surfaces.

According to the aforementioned configuration, each of the first and second sensors is formed of a laser sensor, so that the first detection data and the second detection data are less likely to be affected by ambient light around the sensor device. Accordingly, the shape of the object may be detected accurately. The laser beams radiated from the first and second sensors in a planar shape are overlapped with each other to form the detection area, so that signals from the first and second sensors may indicate shapes of the first and second surfaces substantially at the same position on the object which is arranged across the detection area. Accordingly, the signals from the first and second sensors may indicate a shape of the object accurately.

With regard to the aforementioned configuration, the object may be a hem portion including a main plate portion which forms the second surface, and a hem strip which is bent from the main plate portion along a bent edge to form a part of the first surface. The applying the coating agent may include moving the nozzle with bringing the bracket into contact with the second surface and the bent edge.

According to the aforementioned configuration, the bracket is brought into contact with the second surface and the bent edge while the coating agent is applied to the object. Therefore, the nozzle may move in accordance with actual shapes of the second surface and the bent edge even under the presence of small differences between the shapes of the second surface and the bent edge in design and the actual shapes of the second surface and the bent edge. Accordingly, the coating agent may be applied to appropriate positions on the object without accurately detecting shapes at a lot of points on the object.

With regard to the aforementioned configuration, the bent edge may form a wheel arch. The applying the coating agent may include applying the sealing agent to the hem edge curved along with the wheel arch.

According to the aforementioned configuration, the sealing agent is applied to the hem edge which is curved along the wheel arch, so that the wheel arch may be appropriately subjected to the rust prevention treatment.

With regard to the aforementioned configuration, the continuously moving the detection area to generate the first detection data may include comparing the first detection data with a predetermined shape threshold value to determine whether or not there is a defect in the object. The applying the coating agent may be performed under a condition without the defect.

According to the aforementioned configuration, the applying a coating agent is performed only under the absence of the defect on the object, so that the coating agent is not applied unnecessarily. Accordingly, the object may be efficiently manufactured.

A coating device according to another aspect of the aforementioned embodiment is configured to apply a coating agent to an object which includes a first surface and a second surface opposite to the first surface. The coating device includes: a controller having a storage configured to store zone information which defines a coating zone extending from a predetermined start point position on the object to a predetermined end point position on the object; a sensor device including a first sensor facing the first surface to detect a shape of the first surface and a second sensor facing the second surface to detect a shape of the second surface, the first and second sensors being configured to form a detection area for detecting a shape of the object; a nozzle configured to apply the coating agent to the object; a bracket configured to hold the sensor device and the nozzle; and a robot configured to move the bracket over the coating zone under a control of the controller. The robot brings the bracket into contact with the object while the coating agent is discharged from the nozzle. The storage stores first detection data acquired by the detection area scanning the object over the coating zone before the coating agent is applied to the object, and second detection data acquired by the detection area scanning the object to which the coating agent has been applied over the coating zone in the detection area. The controller includes: (i) an extractor configured to extract first extraction data in correspondence to detection positions intermittently set in the coating zone from the first detection data, and second extraction data in correspondence to the detection positions from the second detection data, and (ii) a comparison portion configured to compare the first extraction data with the second extraction data and detect a coating state of the coating agent.

According to the aforementioned configuration, the bracket which holds the nozzle for discharging the coating agent moves with being brought into contact with the object when the coating agent is applied to the object. Accordingly, the nozzle may move in accordance with an actual shape of the object even under the presence of small differences between the shape of the object in design and the actual shape of the object. Therefore, the coating agent may be applied to appropriate positions on the object even without accurately detecting shapes at a lot of points on the object. Consequently, the shape of the object may not be detected continuously over the whole coating zone. In short, the shape detection of the object may be performed for the detection positions intermittently set in the coating zone. Accordingly, it is possible to reduce effort and time necessary for the shape detection.

The first extraction data and the second extraction data in correspondence to the detection positions intermittently set in the coating zone are extracted from the first detection data and the second detection data respectively, so that the setting of the detection positions may be dependent on computer techniques. The bracket may not be stopped at the detection positions, so that it is possible to reduce effort and time necessary for the shape detection.

The second extraction data indicates a shape of the object resultant from overlapping the shape of the object before the coating agent is applied to the object with the shape of the coating agent on the object. Accordingly, the shape of the coating agent on the object (i.e. a coating state of the coating agent) may be obtained by comparing the first extraction data indicating the shape of the object before the coating agent is applied to the object with the second extraction data. Consequently, it is possible to determine whether or not the coating agent is appropriately applied to the object.

With regard to the aforementioned configuration, the object may be a hem portion including a main plate portion, and a hem strip which is bent from the main plate portion along a bent edge. The robot may be configured to move the nozzle under a control of the controller with bringing the bracket into contact with the second surface and the bent edge.

According to the aforementioned configuration, the bracket is brought into contact with the second surface and the bent edge while the coating agent is applied to the object. Accordingly, the nozzle may move in accordance with actual shapes of the second surface and the bent edge even under the presence of small differences between shapes in design and actual shapes of the second surface and the bent edge. Therefore, the coating agent may be applied to appropriate positions on the object even without accurately detecting shapes at a lot of points on the object.

INDUSTRIAL APPLICABILITY

The principles of the aforementioned embodiments are preferably used in various manufacturing sites.

The invention claimed is:

1. A coating method using a nozzle for discharging a coating agent, a first sensor configured to detect a shape of a first surface of an object and a second sensor configured to detect a shape of a second surface of the object which is opposite to the first surface comprising:

continuously moving a detection area formed by the first and second sensors which are held by a bracket so that the first sensor faces the first surface whereas the second sensor faces the second surface to make the object be situated between the first and second sensors, over a coating zone which extends from a predetermined start point position to a predetermined end point position to make the first and second sensors detect the shapes of the first and second surfaces before application of the coating agent to the object and generate first detection data;

moving the bracket which holds the nozzle with bringing the bracket into contact with the object to apply the coating agent to the object over the coating zone;

continuously moving the detection area over the coating zone to make the first and second sensors between which the object is situated detect the shapes of the first and second surfaces after the application to the coating agent to the object and generate second detection data;

extracting first extraction data in correspondence to detection positions intermittently set in the coating zone from the first detection data, and second extraction data in correspondence to the detection positions from the second detection data; and comparing the first extraction data with the second extraction data to detect a coating state of the coating agent.

2. The coating method according to claim 1, wherein the object is a hem portion including a main plate portion which forms the second surface, and a hem strip which is bent from the main plate portion along a bent edge to form a part of the first surface, wherein the hem strip includes a hem edge extending in an extending direction of the bent edge at a position spaced apart from the bent edge, and wherein the moving the bracket to apply the coating agent includes applying a sealing agent as the coating agent to the hem edge.

3. The coating method according to claim 2, wherein the continuously moving the detection area includes detecting a position of the hem edge, and wherein the moving the bracket to apply the coating agent includes adjusting a position of the nozzle in accordance with the position of the hem edge.

4. The coating method according to claim 2, wherein the bent edge forms a wheel arch, and wherein the moving the bracket to apply the coating agent includes applying the sealing agent to the hem edge curved along with the wheel arch.

5. The coating method according to claim 1, wherein each of the first and second sensors is formed of a laser sensor, and wherein the continuously moving the detection area includes:

(i) overlapping a laser beam in a planar shape, which is radiated from the first sensor, with a laser beam in planar shape, which is radiated from the second sensor, to form the detection area; and (ii) arranging the object across the detection area to optically detect the shapes of the first and second surfaces.

6. The coating method according to claim 1, wherein the object is a hem portion including a main plate portion which forms the second surface, and a hem strip which is bent from the main plate portion along a bent edge to form a part of the first surface, and wherein the moving the bracket to apply the coating agent includes moving the nozzle with bringing the bracket into contact with the second surface and the bent edge.

7. The coating method according to claim 1, wherein the continuously moving the detection area to generate the first detection data includes comparing the first detection data with a predetermined shape threshold value to determine whether or not there is a defect in the object, and wherein the moving the bracket to apply the coating agent is performed under a condition without the defect.

* * * * *